US010180014B2

(12) United States Patent
Tanaka et al.

(10) Patent No.: US 10,180,014 B2
(45) Date of Patent: Jan. 15, 2019

(54) KEY DRIVE DEVICE

(71) Applicant: SONY CORPORATION, Tokyo (JP)

(72) Inventors: Akichika Tanaka, Kanagawa (JP); Tomohisa Nara, Tokyo (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 15/556,048

(22) PCT Filed: May 10, 2016

(86) PCT No.: PCT/JP2016/002288
§ 371 (c)(1),
(2) Date: Sep. 6, 2017

(87) PCT Pub. No.: WO2016/194304
PCT Pub. Date: Dec. 8, 2016

(65) Prior Publication Data

US 2018/0044943 A1 Feb. 15, 2018

(30) Foreign Application Priority Data

Jun. 2, 2015 (JP) ..... 2015-112093
Jul. 7, 2015 (JP) ..... 2015-136207

(51) Int. Cl.

| | |
|---|---|
| ***F04D 15/00*** | (2006.01) |
| ***E05B 47/00*** | (2006.01) |
| *E05B 39/04* | (2006.01) |
| *E05B 63/00* | (2006.01) |

(52) U.S. Cl.
CPC ..... *E05B 47/0012* (2013.01); *E05B 39/04* (2013.01); *E05B 63/0056* (2013.01); *E05B 2047/003* (2013.01); *E05B 2047/0022* (2013.01); *E05B 2047/0026* (2013.01); *E05B 2047/0067* (2013.01); *E05B 2047/0083* (2013.01); *E05B 2047/0091* (2013.01); *E05B 2047/0094* (2013.01); *E05B 2047/0095* (2013.01)

(58) Field of Classification Search
CPC ..... E05B 2047/002; E05B 81/34
See application file for complete search history.

(56) References Cited

U.S. PATENT DOCUMENTS 6,591,643 B1 7/2003 Cannella et al.
2016/0201773 A1* 7/2016 Ta ..... E05B 81/02 74/421 A

FOREIGN PATENT DOCUMENTS

| | | | |
|---|---|---|---|
| DE | 202004020588 | U1 | 8/2005 |
| EP | 0849422 | A1 | 6/1998 |
| EP | 1098056 | A1 | 5/2001 |
| EP | 2762661 | A1 | 6/2014 |

(Continued)

*Primary Examiner* — Karen Masih
(74) *Attorney, Agent, or Firm* — Paratus Law Group, PLLC

(57) ABSTRACT

There is provided an electrical key lock device, including a second gear configured to rotate by driving power received from a motor, a first gear configured to transfer the driving power, received through the rotation of the second gear, to an external rotational element, and a third gear arranged between the second gear and the first gear and configured to transfer the driving power generated by the motor to the first gear. The third gear enables switching between closing and opening of a transfer path of the driving power between the second gear and the first gear.

17 Claims, 20 Drawing Sheets

(56) References Cited

FOREIGN PATENT DOCUMENTS

| | | |
|---|---|---|
| JP | 2007-239347 | 9/2007 |
| WO | WO2004/059110 A1 | 7/2004 |

* cited by examiner

[Fig. 1]
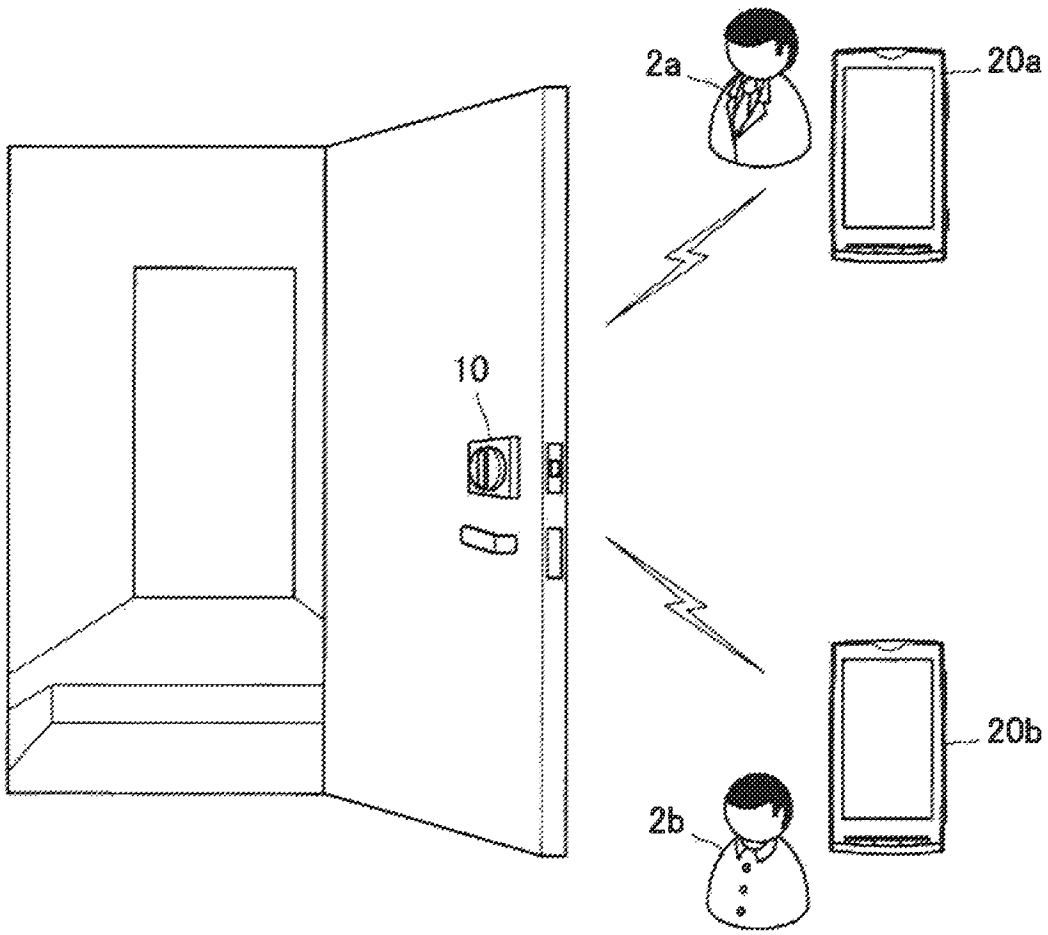

[Fig. 2]
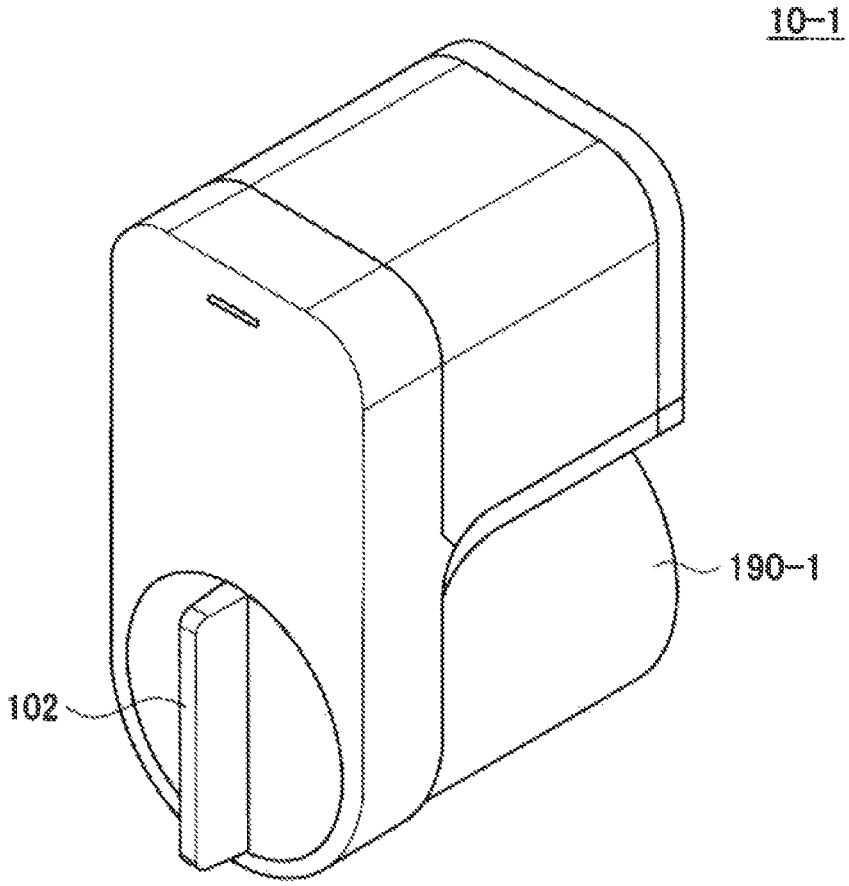

[Fig. 3]
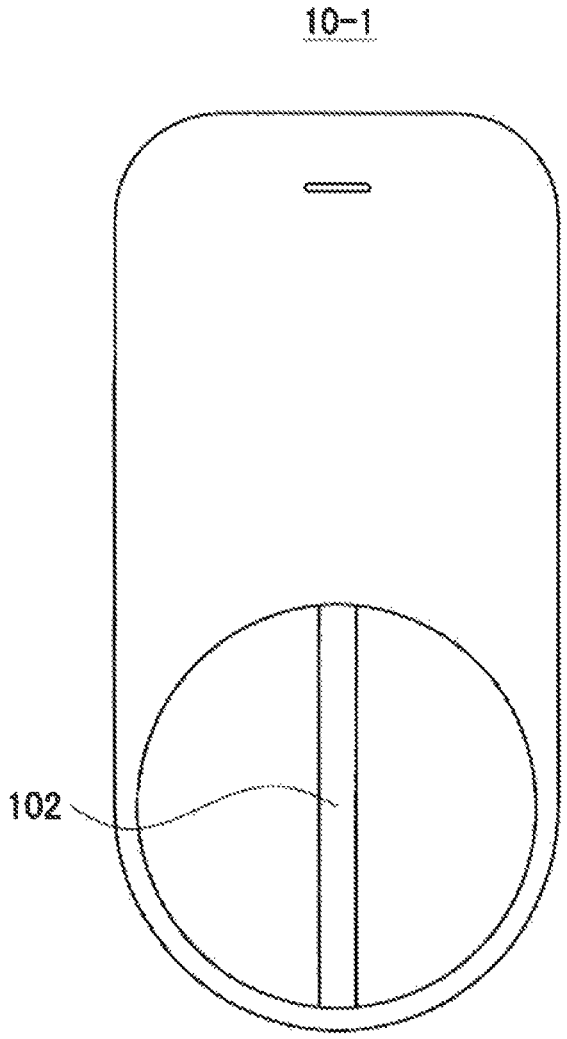

[Fig. 4]
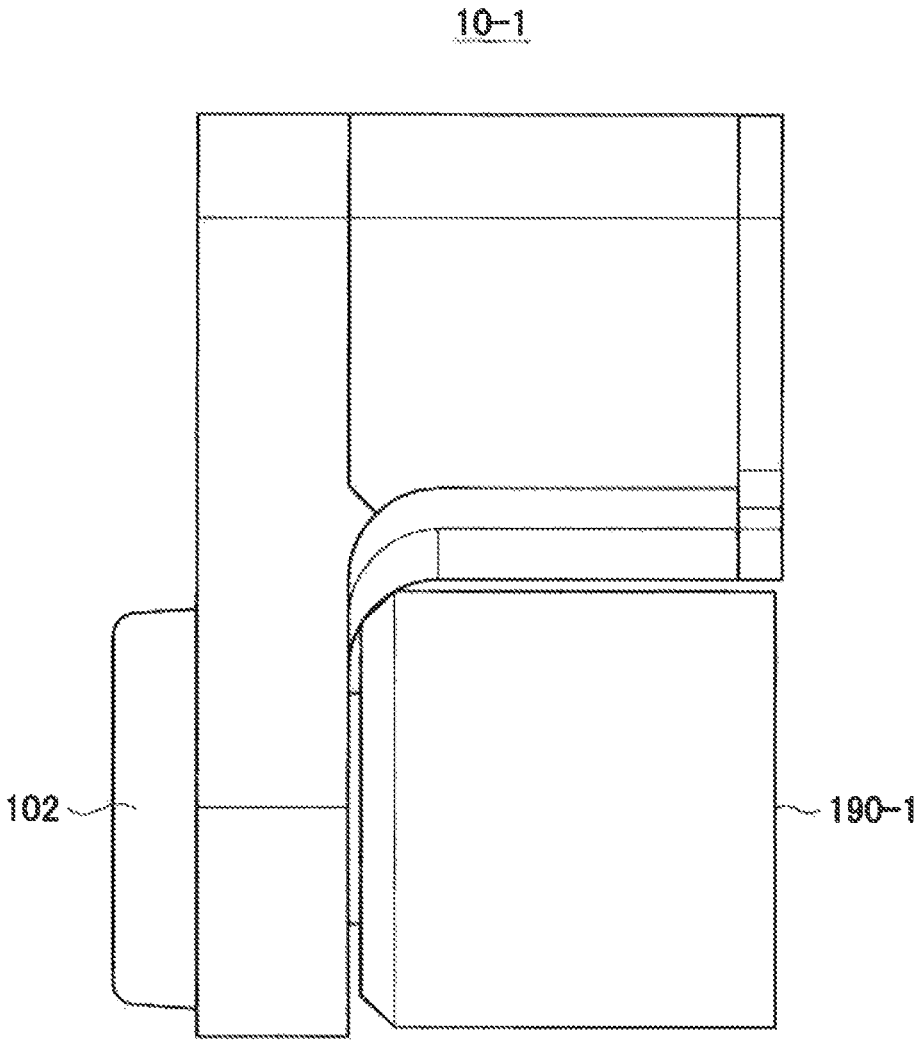

[Fig. 5]
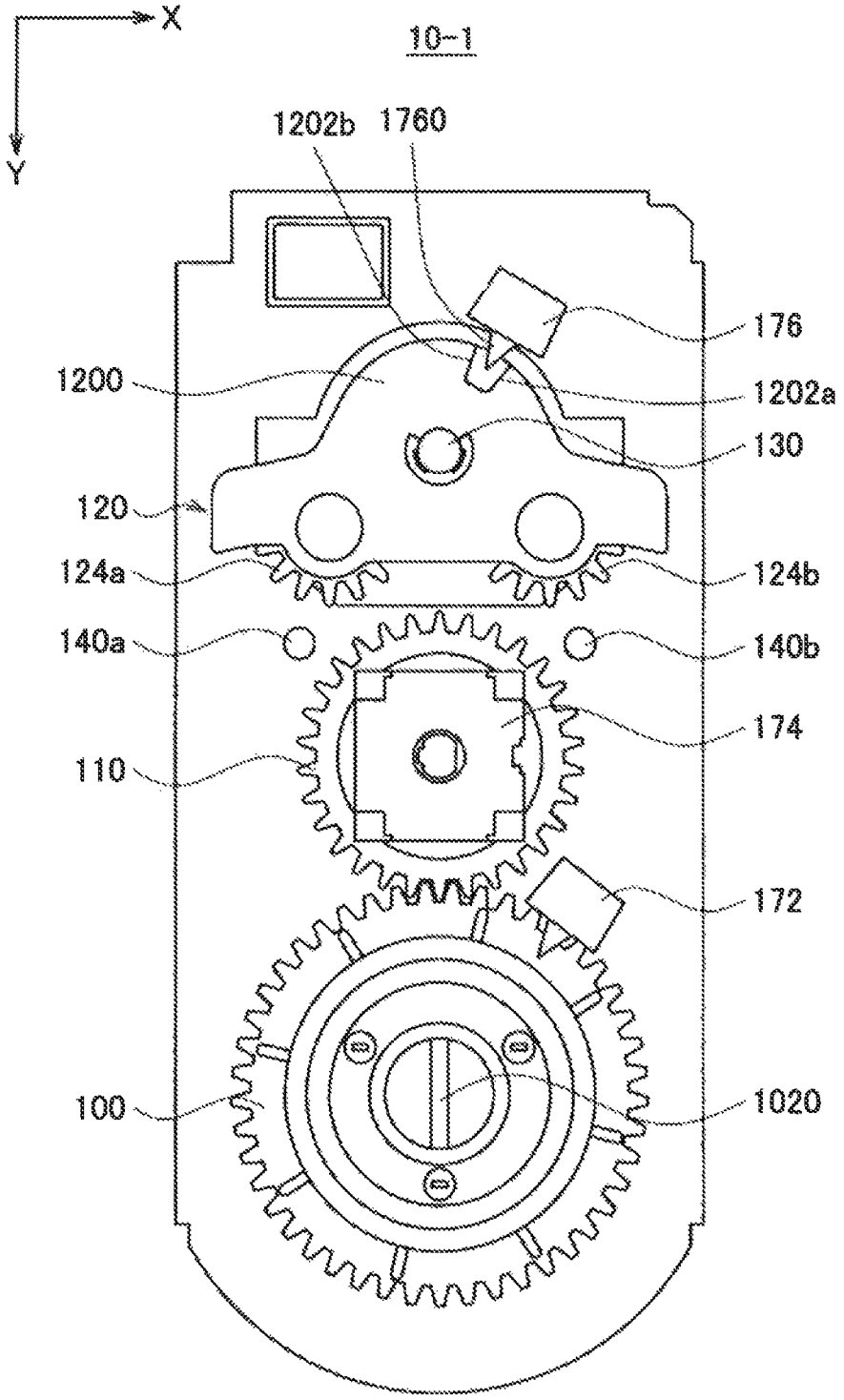

[Fig. 6]
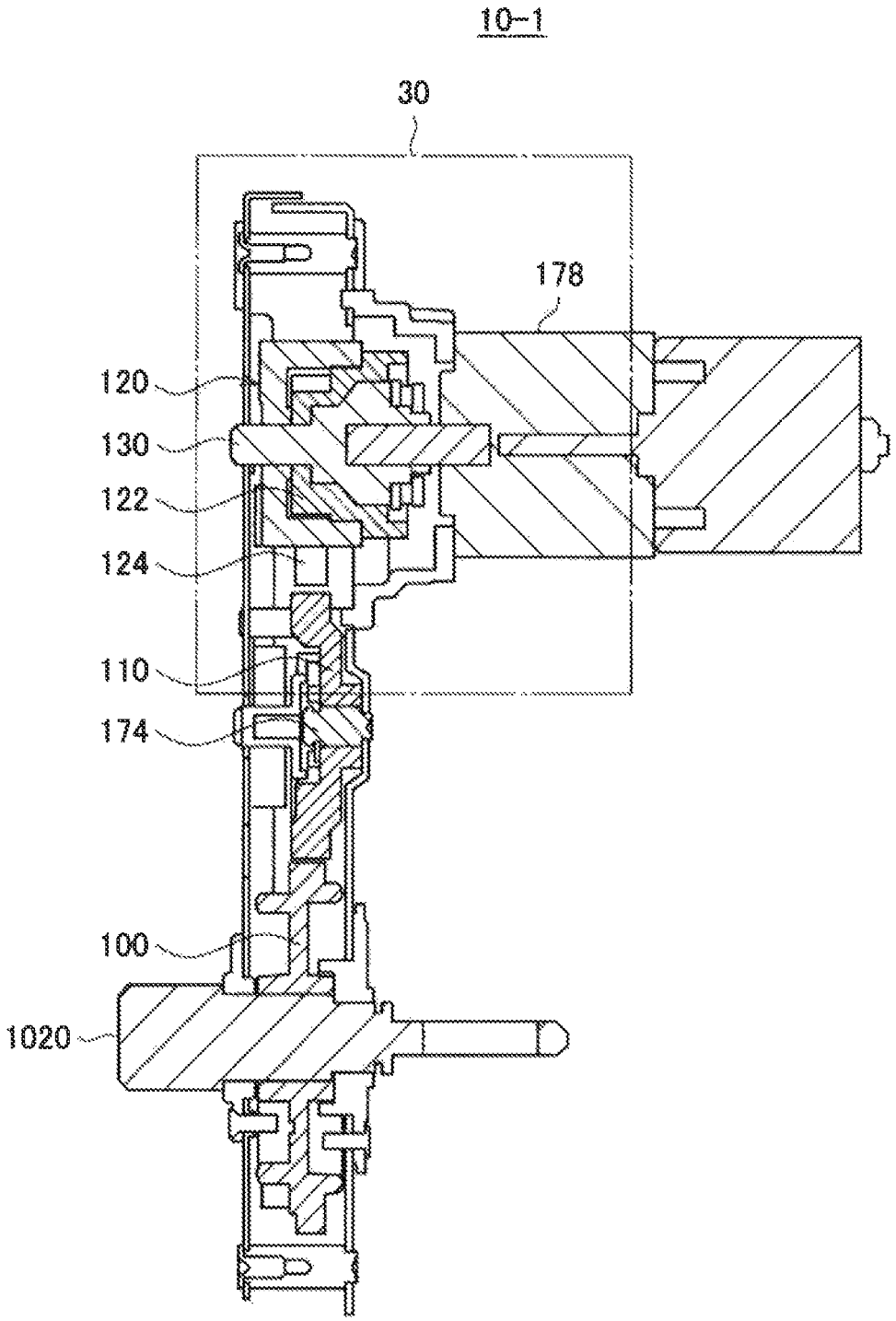

[Fig. 7]
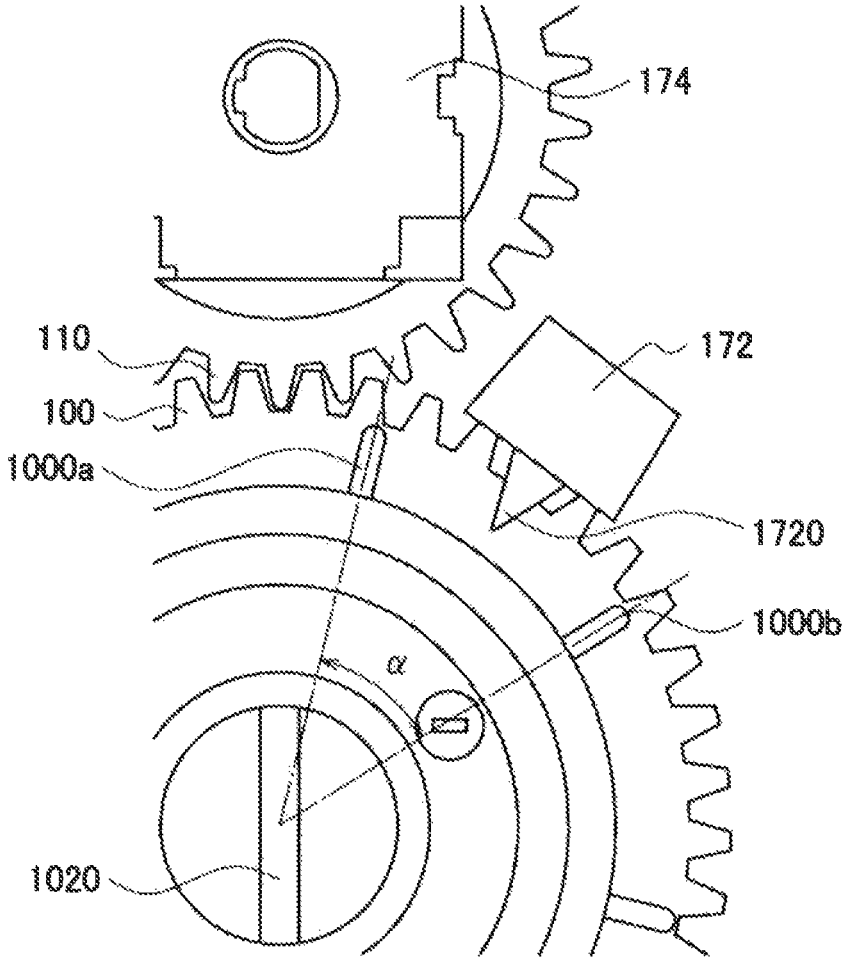

[Fig. 8]
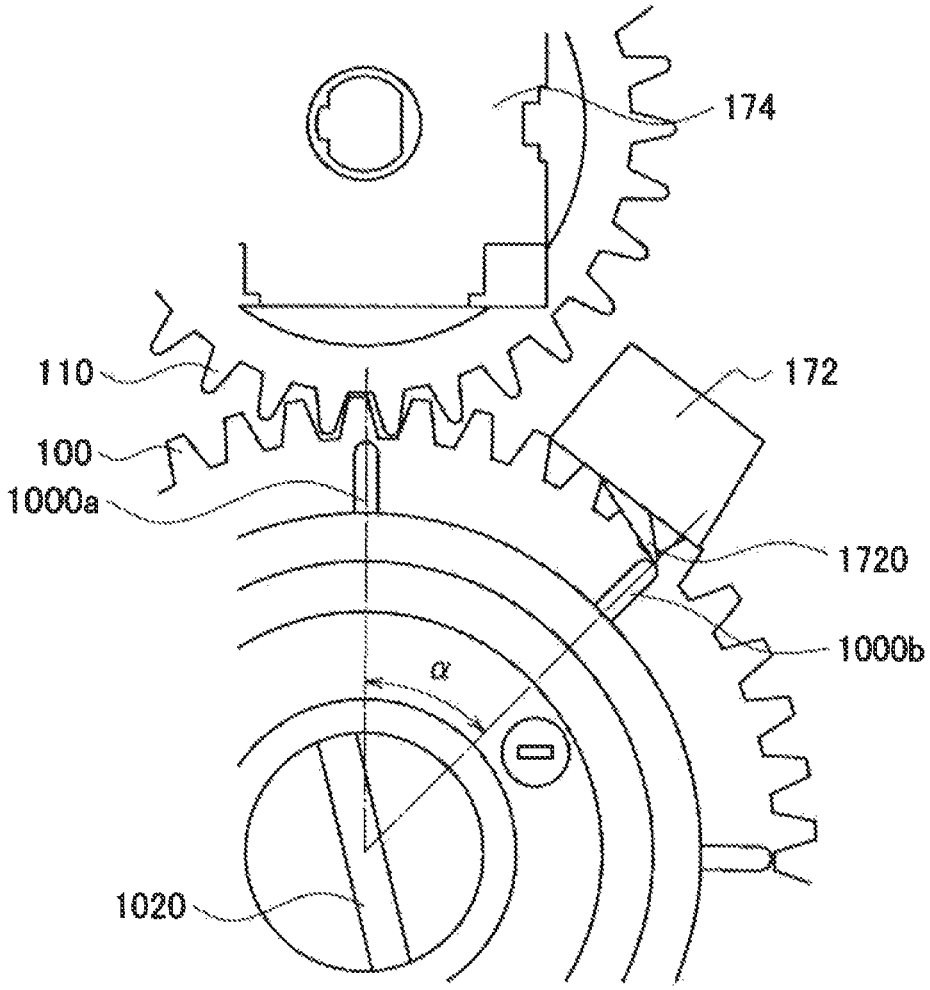

[Fig. 9]
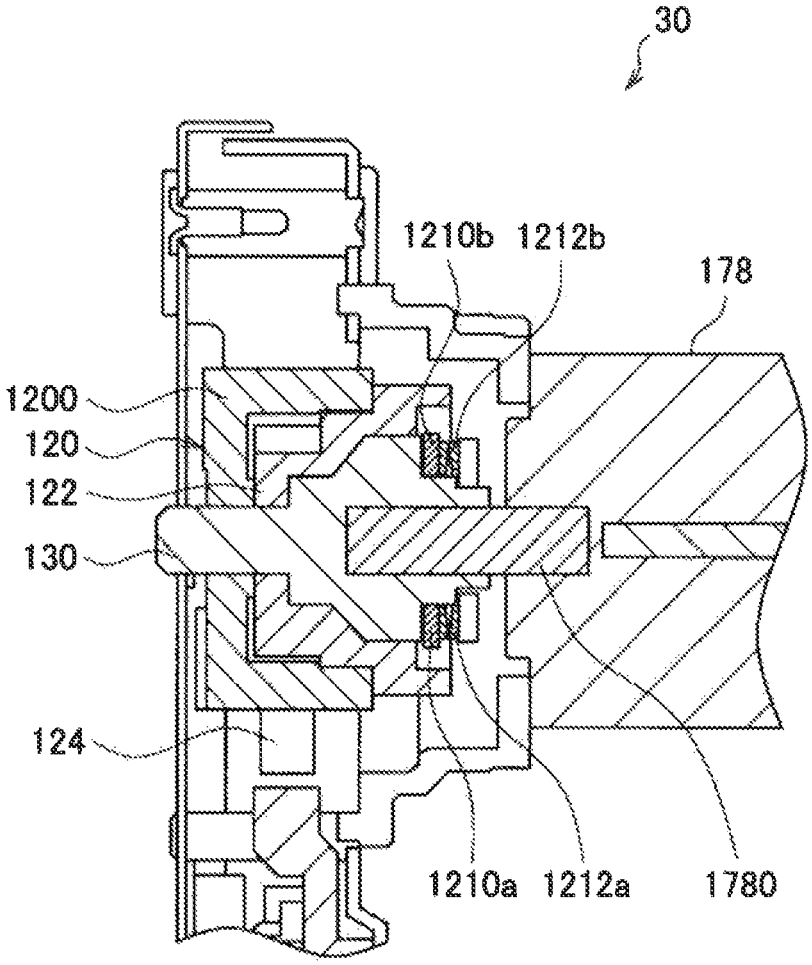

[Fig. 10]
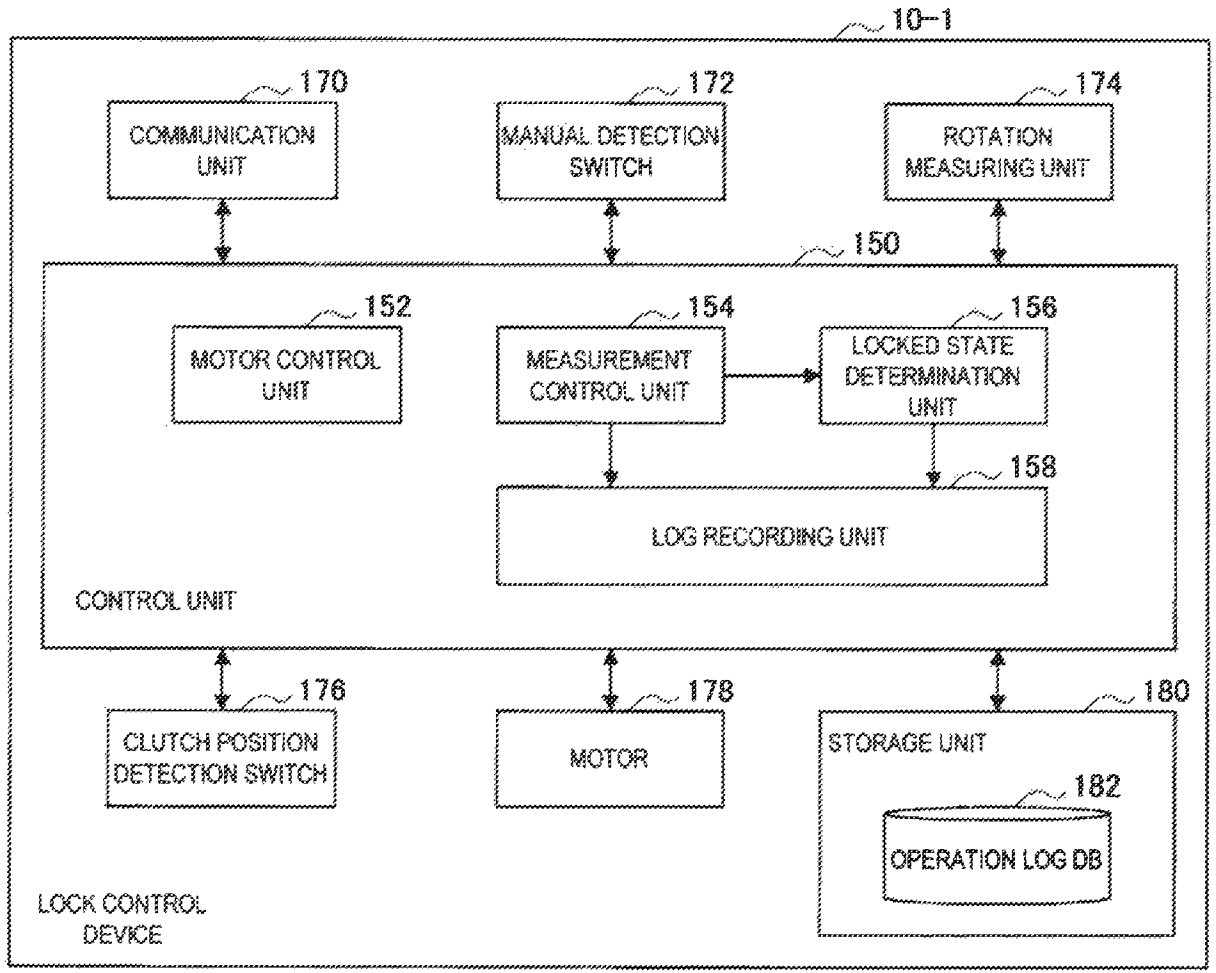

[Fig. 11]
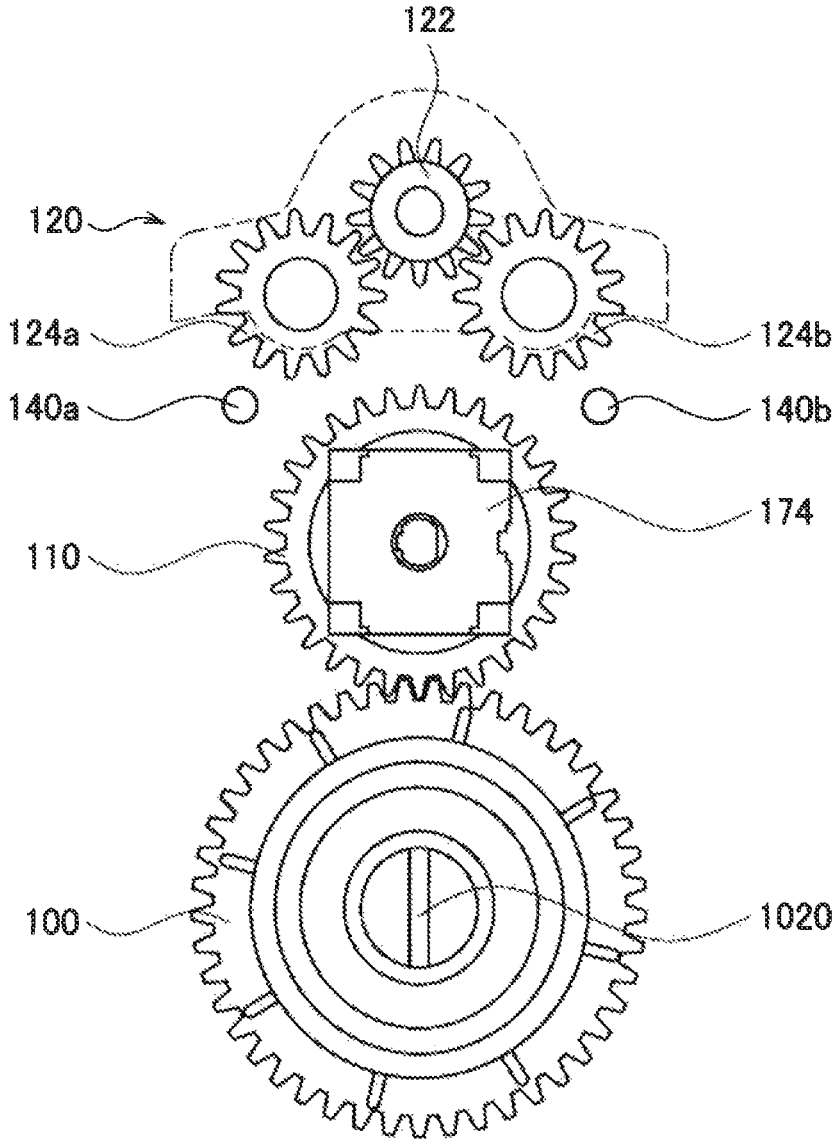

[Fig. 12]
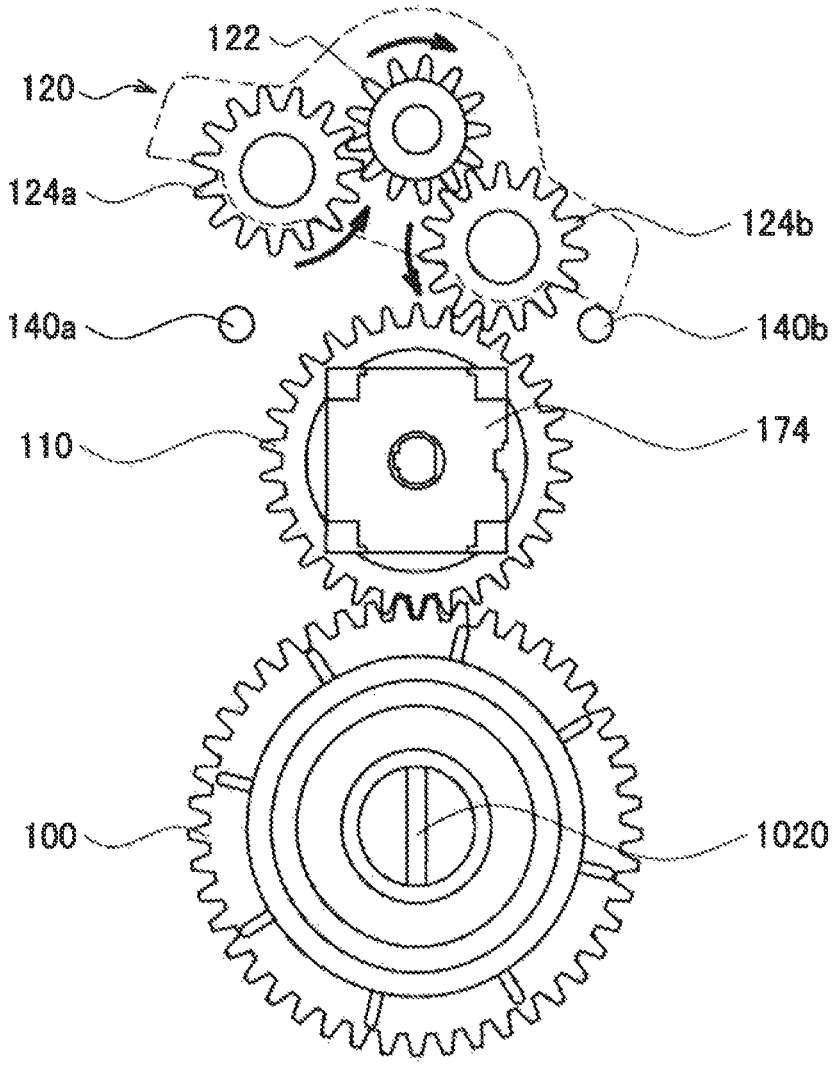

[Fig. 13]
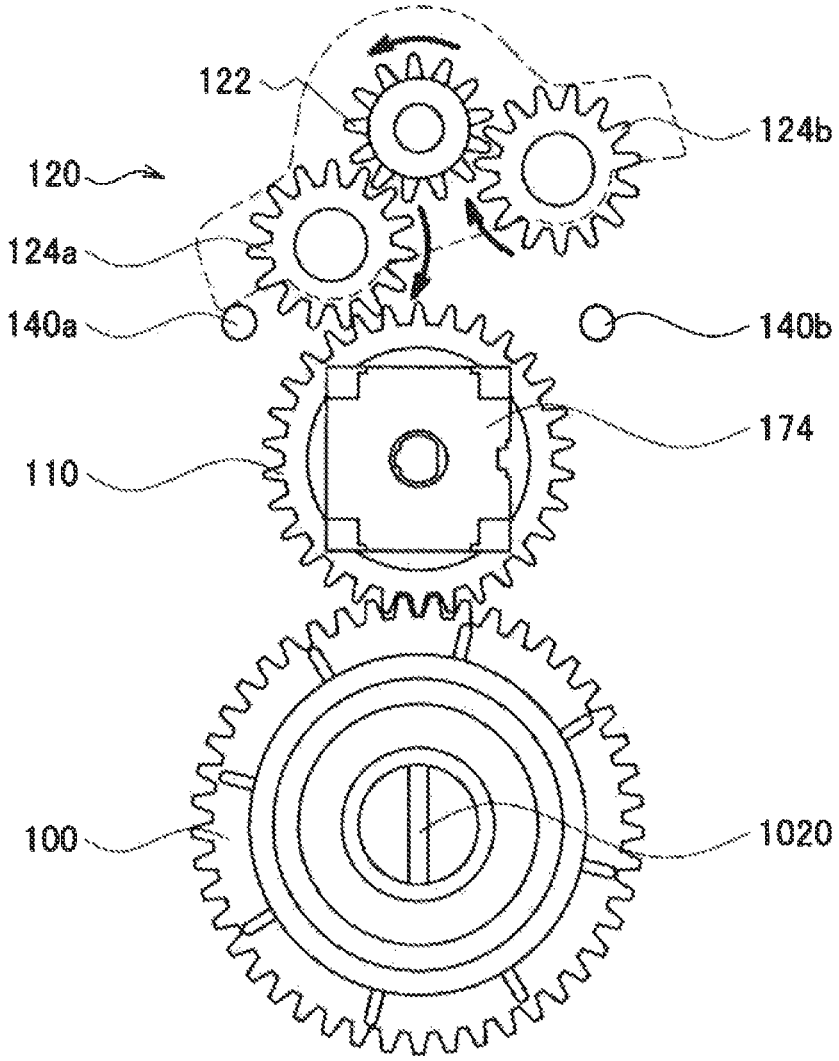

[Fig. 14]
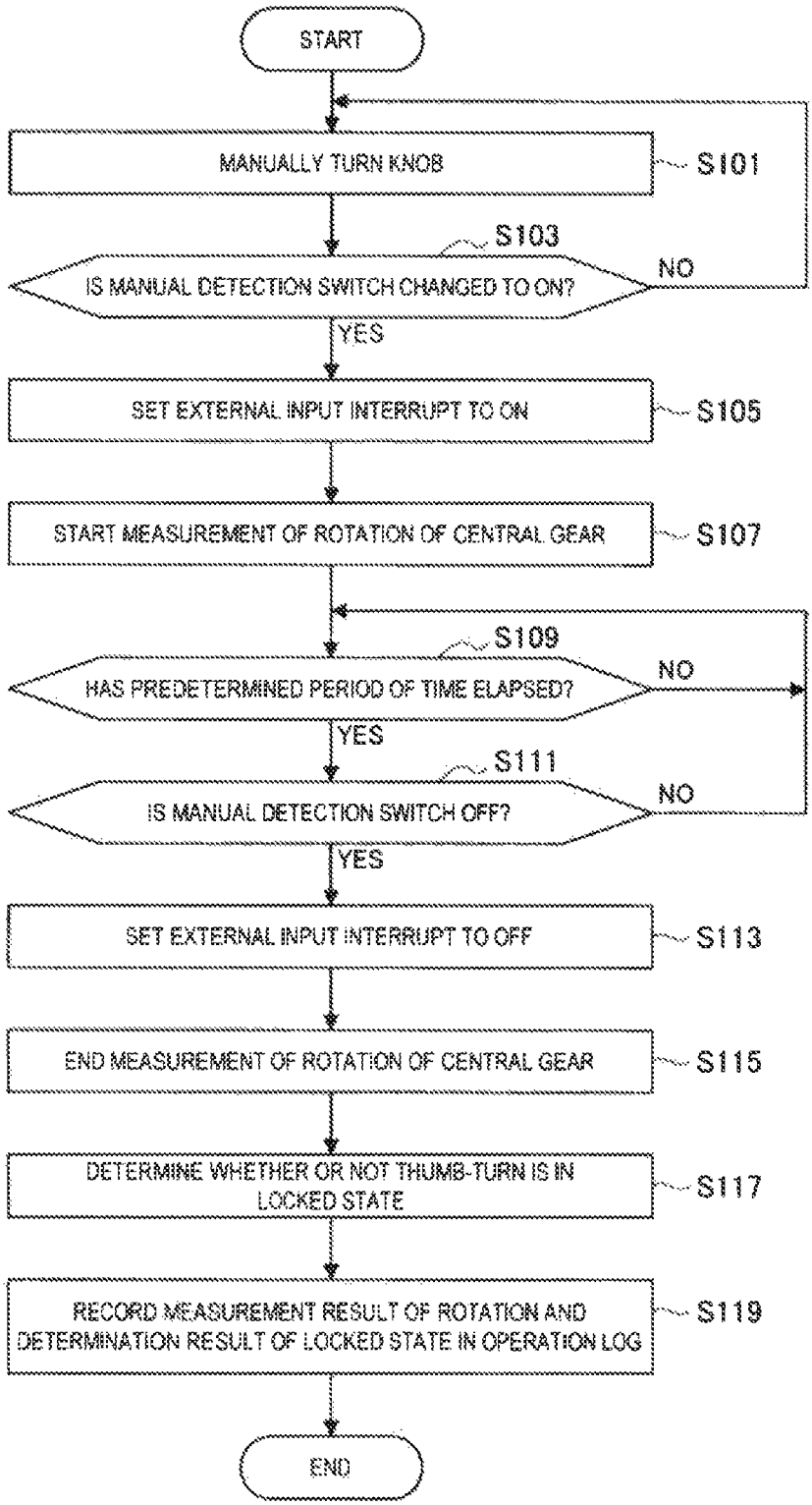

[Fig. 15]
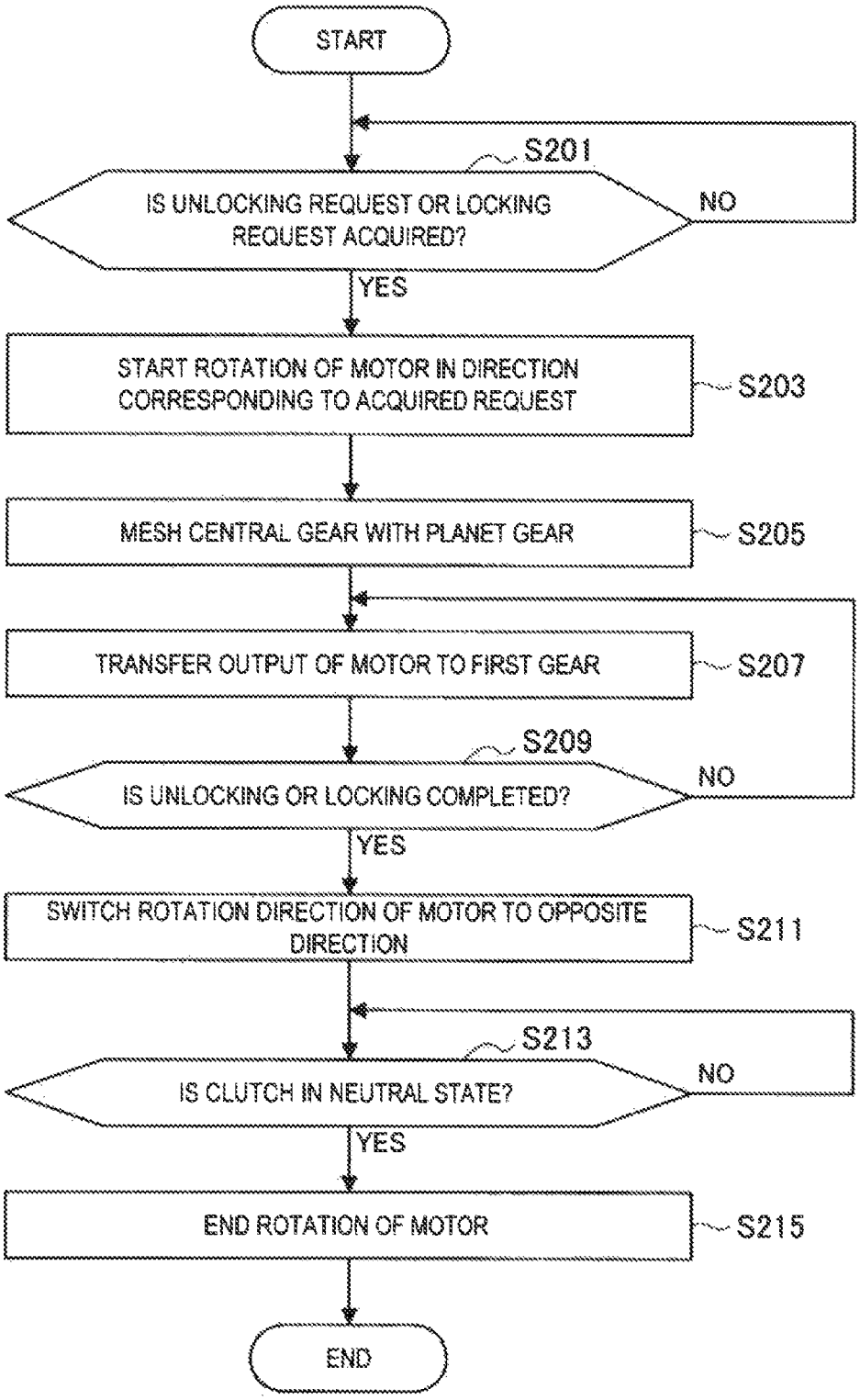

[Fig. 16]
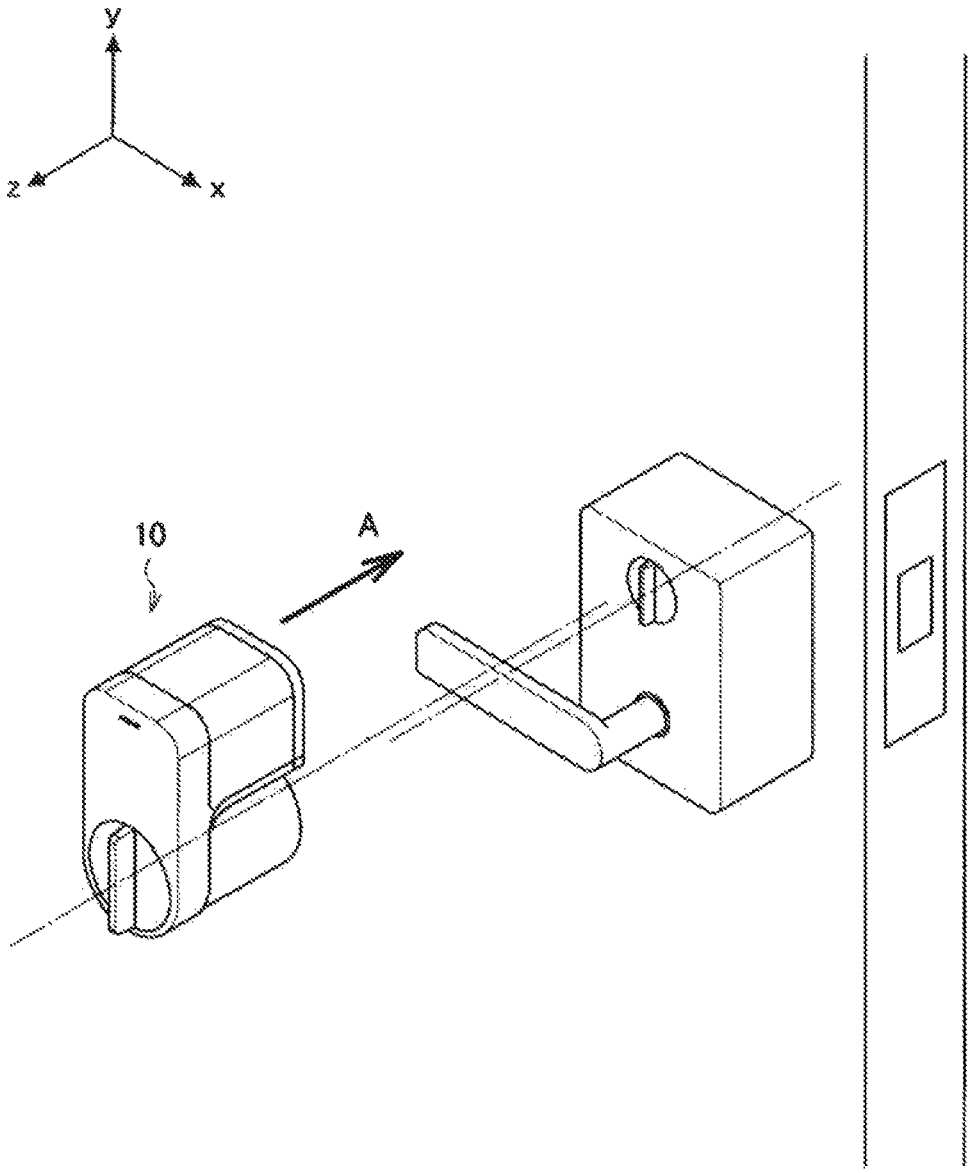

[Fig. 17]
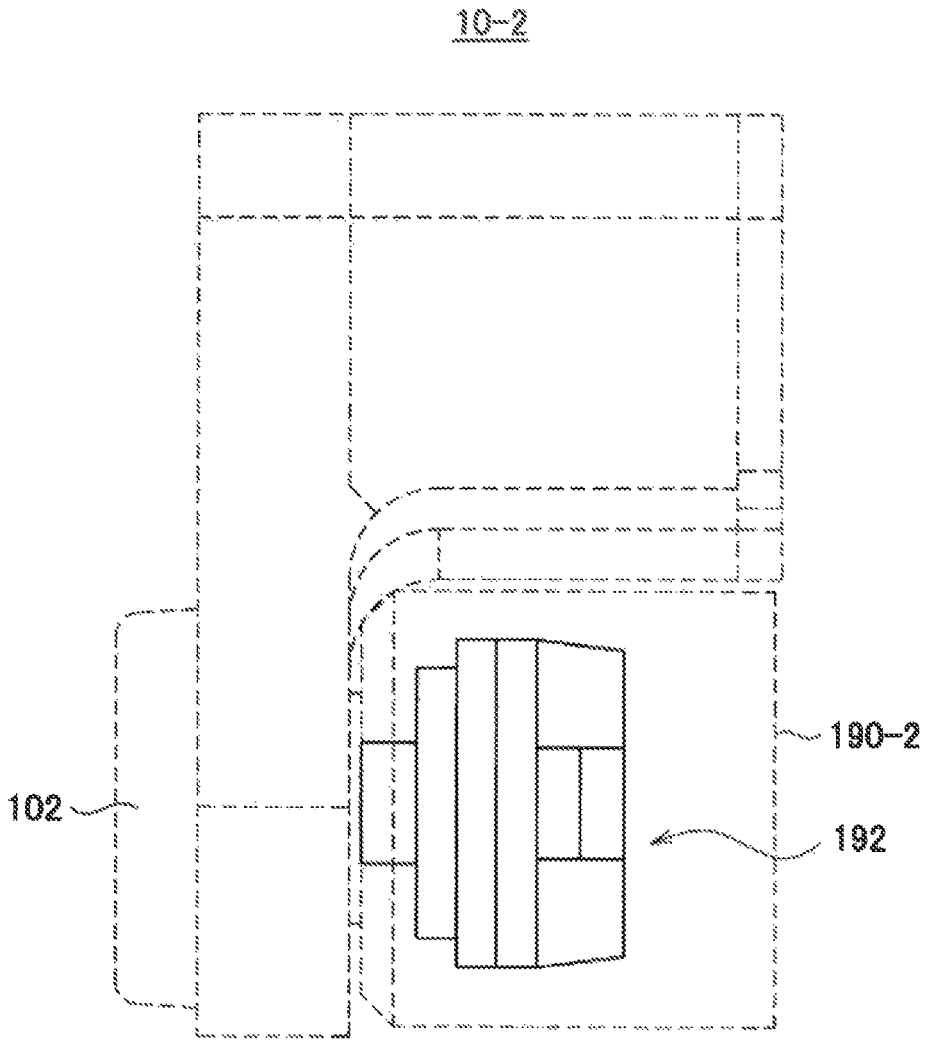

[Fig. 18]
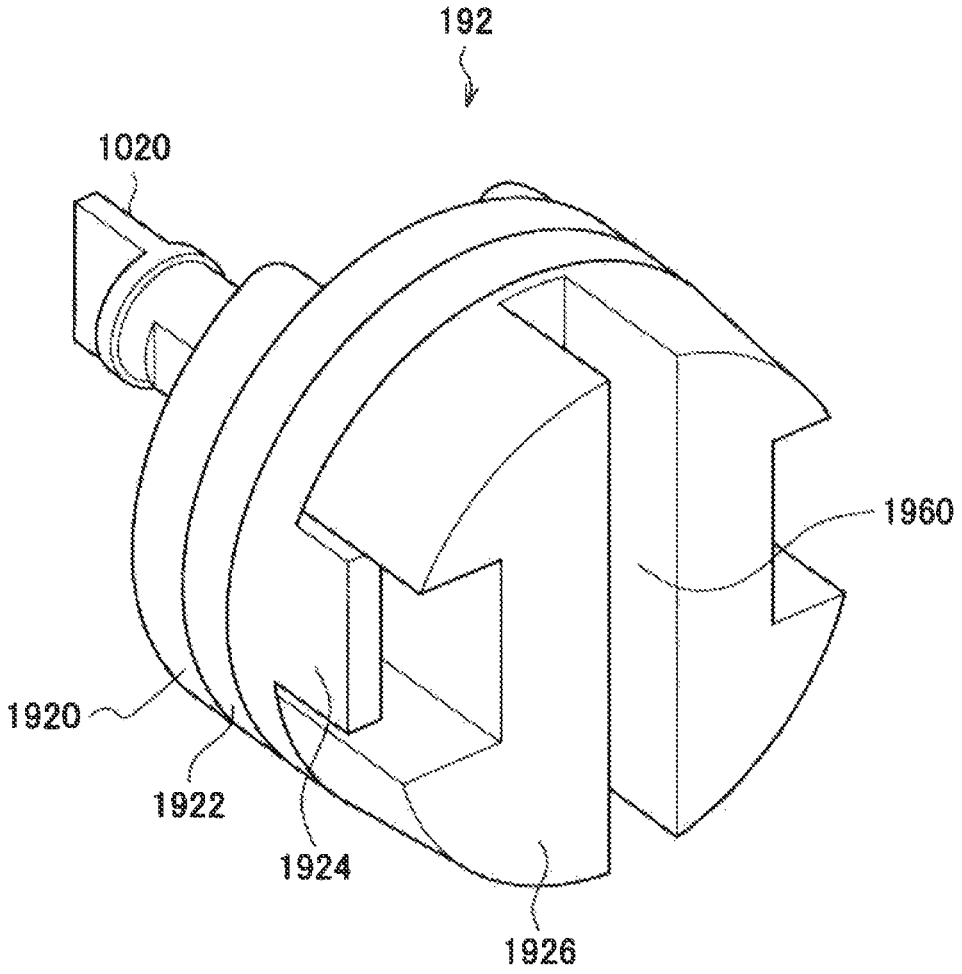

[Fig. 19]
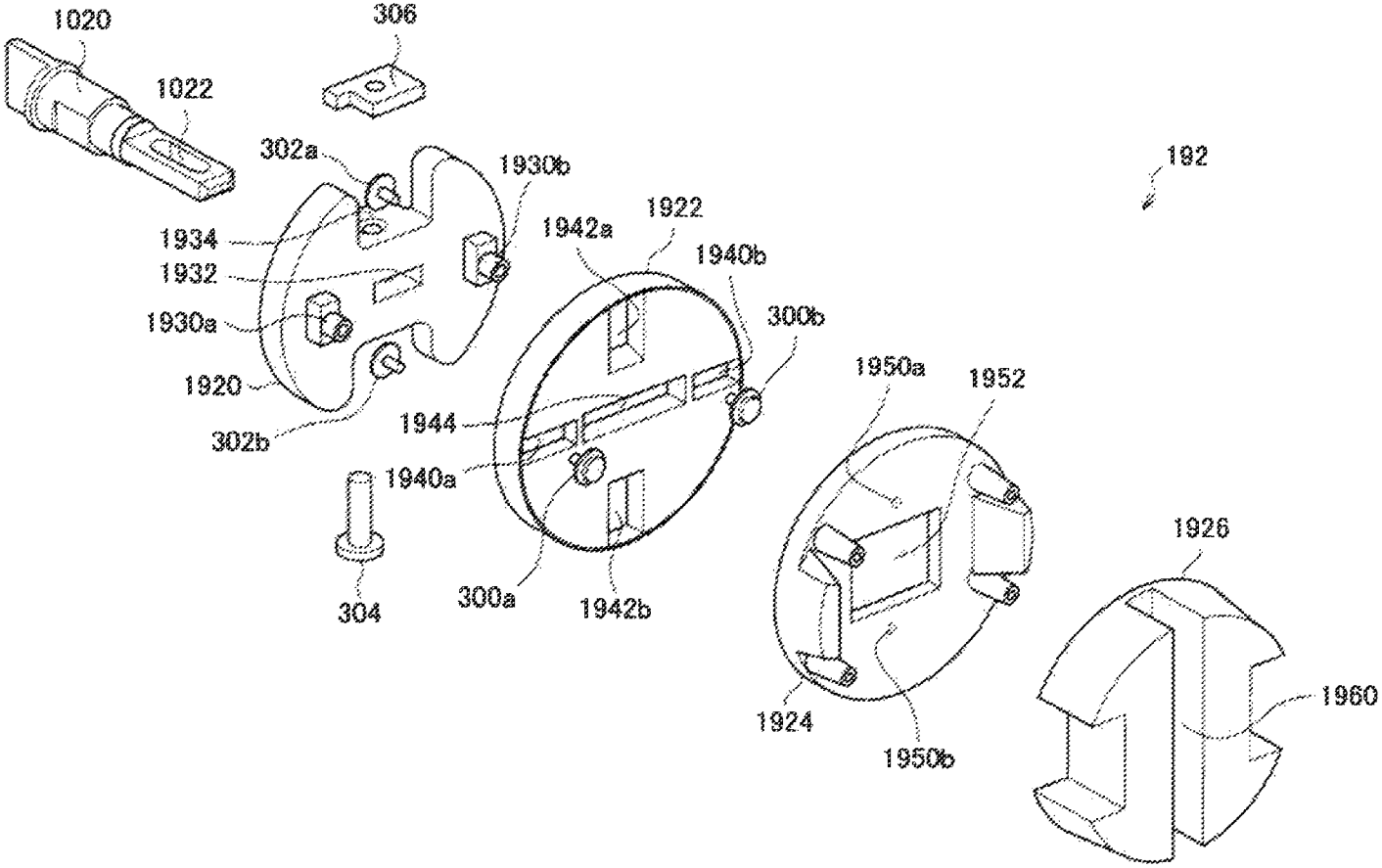

[Fig. 20]
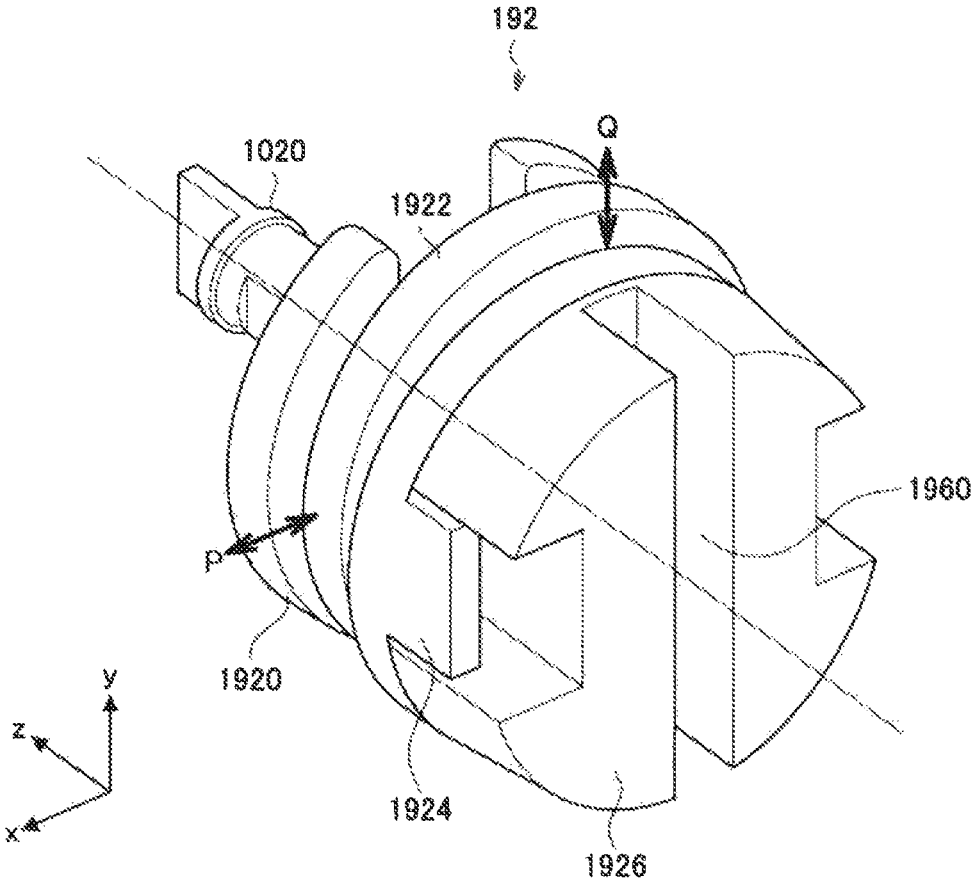

KEY DRIVE DEVICE

CROSS REFERENCE TO RELATED APPLICATIONS

This application is a National Stage Patent Application of PCT International Patent Application PCT/JP2016/002288 filed May 10, 2016 under 35 U.S.C. § 371, which claims the benefit of Japanese Priority Patent Application JP 2015-112093 filed Jun. 2, 2015, and Japanese Priority Patent Application JP 2015-136207 filed Jul. 7, 2015, the entire contents of each of which are incorporated herein by reference.

TECHNICAL FIELD

The present disclosure relates to a key drive device.

BACKGROUND ART

Since the past, thumb-turns have been installed in doors in order to enable the doors to be unlocked or locked.

An electrical lock capable of electrically performing unlocking and locking of a door has been developed as well. For example, PTL 1 discloses a technique in which an electrical lock reads key data from a portable device, and performs unlocking control when the portable device is held over the electrical lock.

A motor type electrical lock in which unlocking or locking is performed by rotating a thumb-turn through motor driving has also been developed.

CITATION LIST

Patent Literature

[PTL 1] JP 2007-239347A

SUMMARY

Technical Problem

However, in the motor type electrical lock of the related art, a transfer path of driving power of the motor is fixed between a gear for rotating the thumb-turn and the motor. For this reason, for example, it is difficult for a user to turn the thumb-turn by a manual operation on the motor type electrical lock.

In this regard, in the present disclosure, it is desirable to propose a key drive device which is novel and improved and enables a thumb-turn to be rotated by driving of a motor and the thumb-turn to be easily rotated by a manual operation.

Solution to Problem

According to an embodiment of the present disclosure, there is provided an electrical key lock device including a second gear configured to rotate by driving power received from a motor, a first gear configured to transfer the driving power, received through the rotation of the second gear, to an external rotational element, and a third gear arranged between the second gear and the first gear and configured to transfer the driving power generated by the motor to the first gear, wherein the third gear enables switching between closing and opening of a transfer path of the driving power between the second gear and the first gear.

Advantageous Effects of Invention

As described above, according embodiments of the present disclosure, it is possible for the thumb-turn to be rotated by driving of the motor and the thumb-turn to be easily rotated by a manual operation. The effect described here is not necessarily limited and may include any effect described in the present disclosure.

BRIEF DESCRIPTION OF DRAWINGS

FIG. 1 is an explanatory view illustrating an exemplary configuration of an information processing system that is common to embodiments of the present disclosure.

FIG. 2 is a perspective view illustrating an exterior of a lock control device 10-1 according to an embodiment.

FIG. 3 is a front view of the lock control device 10-1 according to an embodiment, FIG. 4 is a left side view of the lock control device 10-1 according to an embodiment.

FIG. 5 is a view illustrating an exterior of portions inside a housing of the lock control device 10-1 according to an embodiment.

FIG. 6 is an explanatory view illustrating a cross section in a direction parallel to a left side surface of the lock control device 10-1 according to an embodiment.

FIG. 7 is an explanatory view illustrating a positional relation of a first gear 100 and a manual detection switch 172 according to an embodiment when a detection result obtained by the manual detection switch 172 is OFF, FIG. 8 is an explanatory view illustrating a positional relation of the first gear 100 and the manual detection switch 172 according to an embodiment when a detection result obtained by the manual detection switch 172 is ON.

FIG. 9 is an enlarged view of a cross-sectional region 30 illustrated in FIG. 6.

FIG. 10 is a functional block diagram illustrating an example of an internal configuration of the lock control device 10-1 according to an embodiment.

FIG. 11 is an explanatory view illustrating a positional relation of a planet gear 124 and a central gear 110 when a motor 178 is stopped according to an embodiment.

FIG. 12 is an explanatory view illustrating a change in a position of the planet gear 124 when the motor 178 rotates in one direction according to an embodiment.

FIG. 13 is an explanatory view illustrating a change in a position of the planet gear 124 when the motor 178 rotates in another direction according to an embodiment.

FIG. 14 is a flowchart illustrating an operation example when unlocking or locking is performed by a manual operation according to an embodiment.

FIG. 15 is a flowchart illustrating an operation example when unlocking or locking is performed by driving of the motor 178 according to an embodiment.

FIG. 16 is an explanatory view illustrating a form in which a lock control device 10-2 is attached to a thumb-turn according to an embodiment of the present disclosure.

FIG. 17 is a left side view illustrating an exterior of portions inside an attachment 190-2 according to an embodiment.

FIG. 18 is a perspective view illustrating a configuration of an Oldham coupling 192 according to an embodiment.

FIG. 19 is an exploded perspective view illustrating a configuration of the Oldham coupling 192 according to an embodiment.

FIG. 20 is a perspective view illustrating a form in which an intermediate member 1922 slides according to an embodiment.

DESCRIPTION OF EMBODIMENTS

Hereinafter, embodiments of the present disclosure will be described in detail with reference to the appended drawings. In this specification and the appended drawings, structural elements that have substantially the same function and structure are denoted with the same reference numerals, and repeated explanation of these structural elements is omitted.

Also, in the present specification and drawings, a plurality of structural elements that have substantially the same function and structure are sometimes distinguished by adding different alphabets after a same reference numeral. For example, a plurality of configurations having substantially same function and structure are distinguished as appropriate, like the user terminal 20*a* and the user terminal 20*b*. However, when a plurality of structural elements that have substantially the same function and structure are needless to be distinguished from each other, only a same reference sign is assigned. For example, when a user terminal 20*a* and a user terminal 20*b* are needless to be distinguished particularly, they are simply referred to as user terminal 20.

Further, "Description of Embodiments" will be described in the following item order.

1. Basic Configuration of Information Processing System
2. First Embodiment
3. Second Embodiment
4. Modifications In this specification and the drawings, a lock control device 10-1 according to an embodiment and a lock control device 10-2 according to an embodiment are also referred to collectively as a "lock control device 10."

1. Basic Configuration of Information Processing System

<1-1. Basic Configuration>

The present disclosure can be implemented in various forms as will be described in detail in "2. First Embodiment" to "3. Second Embodiment," for example. First, a basic configuration of an information processing system that is common to embodiments will be described with reference to FIG. 1. As illustrated in FIG. 1, the information processing system that is common to embodiments includes a lock control device 10 and a user terminal 20.

{1-1-1. Lock Control Device 10}

The lock control device 10 is an example of a key drive device in the present disclosure. The lock control device 10 is a device that is attached to, for example, an inside of a house and controls locking and unlocking of a door. For example, the lock control device 10 performs control such that a thumb-turn (not illustrated) installed in a door is rotated for unlocking or locking.

The lock control device 10 can perform transmission and reception of information with the user terminal 20 which will be described later through wireless communication, for example, according to Bluetooth such as Bluetooth (a registered trademark) low energy (BLE), Wi-Fi (a registered trademark), or near field communication (NFC). For example, the lock control device 10 receives a process request such as an unlocking request or a locking request from the user terminal 20.

{1-1-2. User Terminal 20}

The user terminal 20 is basically a portable terminal owned by a user 2. Examples of the user terminal 20 include a mobile phone such as a smartphone, a tablet terminal, a wristwatch type device, a glasses type device, and a headphone with a communication function according to, for example, Bluetooth or the like.

Dedicated applications for making various kinds of process requests such as an unlocking request to the lock control device 10-1 may be installed in the user terminal 20.

<1-2. Description of Problems>

{1-2-1. Problem 1}

The configuration of the information processing system that is common to embodiments has been described above. Meanwhile, in the past, a motor type electrical lock in which unlocking or locking is performed by motor driving was also developed. However, in the known motor type electrical lock, there is a problem in that when the user manually performs unlocking or locking, a load of the motor is applied to the hand of the user. For this reason, the manual operation becomes heavy, and, for example, for users such as children or the elderly, it is very difficult to manually perform unlocking or locking.

{1-2-2. Problem 2}

Further, an electrical lock of a system in which a backlash of within 90° is set to reduce a load of a motor has also been proposed. For example, an electrical lock in which a motor rotates a knob 180° in one direction and then rotates the knob 90° in an opposite direction has been proposed. According to this configuration, since a 90° backlash occurs, the user can easily turn the knob manually if the backlash is within 90°.

However, thumb-turns in which a rotation angle for unlocking or locking is larger than 90° are currently widespread. In an electrical lock including such a thumb-turn in which the rotation angle is larger than 90°, it is also difficult to manually perform unlocking or locking even when a backlash occurs.

{1-2-3. Problem 3}

The following is also a problem. Generally, for example, it is desirable to record a log of manual operations on an electrical lock for the purpose of real estate management or the like. In order to record the log of the manual operations, it is necessary for the electrical lock to detect the manual operations using a rotation measurement sensor, for example.

However, common rotation measurement sensors are high in power consumption. As a result, electric energy of a battery cell mounted in the electrical lock is likely to become insufficient in a short time.

In this regard, the lock control devices 10 according to embodiments were devised in light of the foregoing. The lock control device 10 can rotate a thumb-turn by driving of a motor 178 and enables a user to easily rotate the thumb-turn by a manual operation. Further, the lock control device 10 can suppress power consumption for recording a log of manual operations.

2. First Embodiment

<2-1. Configuration>

{2-1-1. Exterior Configuration}

Next, a configuration according to the first embodiment will be described in detail. First, an exterior configuration of the lock control device 10-1 according to the first embodiment will be described with reference to FIGS. 2 to 4. FIG. 2 is a perspective view illustrating an exterior of the lock control device 10-1. FIG. 3 is a front view of the lock control device 10-1. FIG. 4 is a left side view of the lock control device 10-1.

As illustrated in FIG. 2 to FIG. 4, the lock control device 10-1 includes a knob 102 and an attachment 190-1. The knob 102 is a portion that allows the user to manually turn the thumb-turn installed in the door, for example. The attachment 190-1 is a portion that is removably coupled to the thumb-turn. For example, the lock control device 10-1 can rotate the thumb-turn through the attachment 190-1 based on driving of the motor 178 which will be described later.

Commonly, it is hard for the user to estimate a magnitude of force from her or his hand when turning the knob 102. If a certain gear is interposed between the knob 102 and the attachment 190-1, large forge is applied to the gear when the user strongly turns the knob 102, and the gear is consequently likely to be broken. In this regard, as illustrated in FIGS. 2 and 4, for example, the knob 102 and the attachment 190-1 may be coaxially installed. According to this configuration, it is possible to improve durability of the lock control device 10-1 when the user turns the knob 102.

Here, an exterior configuration inside a housing of the lock control device 10-1 will be described with reference to FIGS. 5 and 6. FIG. 5 is an explanatory view (a front view) illustrating an exterior configuration inside a housing of the lock control device 10-1. FIG. 6 is an explanatory view illustrating a cross section in a direction parallel to a left side surface of the lock control device 10-1. As illustrated in FIGS. 5 and 6, the lock control device 10-1 includes a first gear 100, a central gear 110, a clutch 120, a torque limiter 130, two stoppers 140*a* and 140*b*, a manual detection switch 172, a clutch position detection switch 176, and the motor 178.

Meanwhile, in most doors that are currently in wide use, a thumb-turn is installed with a distance from a door end to a thumb-turn center of, for example, 30 mm or more. For this reason, in order to enable the lock control device 10-1 to be installed in as many types of doors as possible, it is desirable to design a body width (that is, the length of the lock control device 10-1 in an X axis direction illustrated in FIG. 5) of the lock control device 10-1 to be a predetermined length or less, for example, 60 mm or less. In this regard, as illustrated in FIG. 5, for example, parts such as the first gear 100, the central gear 110, and the clutch 120 may be arranged in a line in a Y axis direction illustrated in FIG. 5. According to this configuration, it is possible to reduce the body width of the lock control device 10-1 to be as narrow as possible.

(2-1-1-1. First Gear 100)

The first gear 100 is a gear that transfers driving power that is transferred from the motor 178 (which will be described later) to rotate the thumb-turn. The knob 102 is coupled to the first gear 100. As illustrated in FIG. 5, for example, an output shaft 1020 is installed at a central position of the first gear 100, and the knob 102 is coupled to the output shaft 1020. The first gear 100 may be installed coaxially with the attachment 190-1.

In most doors that are currently used, a door handle or the like is arranged below a thumb-turn. For this reason, when the knob 102 and the attachment 190-1 are coaxially installed as described above, if a part such as the central gear 110 is arranged below the first gear 100, the bottom of the lock control device 10-1 is positioned below the thumb-turn by the length of the arranged part or more when the lock control device 10-1 is installed in the door. For this reason, the bottom of the lock control device 10-1 interferes with the door handle installed in the door or the like, and thus it may be difficult to install the lock control device 10-1 in the door. In this regard, as illustrated in FIG. 5, the first gear 10-1 may be installed below the central gear 110. According to this configuration, it is possible to further reduce the distance between the thumb-turn and the bottom of the lock control device 10-1, and thus it is possible to install the lock control device 10-1 in more types of doors.

(2-1-1-2. Central Gear 110)

The central gear 110 is a gear that is installed to mesh with the first gear 100 as illustrated in FIG. 5. The central gear 110 may be installed between the first gear 100 and a planet gear 124 as described above. A rotation measuring unit 174 is installed on the central gear 110 as illustrated in FIG. 5.

(2-1-1-3. Rotation Measuring Unit 174)

The rotation measuring unit 174 is a sensor that measures a rotation amount of the first gear 100. For example, the rotation measuring unit 174 measures the rotation amount of the first gear 100 by measuring the rotation amount of the central gear 110.

The rotation measuring unit 174 further measures a rotational angle and a rotation direction of the first gear 100. The rotation measuring unit 174 measures the rotation amount of the first gear 100 as a signed angle when a sign is set in association with the rotation direction in advance, for example, an angle has a positive value when the rotation direction is clockwise and a negative value when the rotation direction is counterclockwise.

The rotation measuring unit 174 is installed on the central gear 110, for example, to save arrangement space because the size of the rotation measuring unit 174 is generally large, or to enable a rotation amount of the first gear 100 of 360° or more to be measured.

(2-1-1-4. Clutch 120)

The clutch 120 is a mechanism that rotates by the driving power received from the motor 178. As illustrated in FIG. 5 or 6, the clutch 120 includes, for example, a sun gear 122, the two planet gears 124, and a carrier 1200. Here, the sun gear 122 is an example of a motor gear in the present disclosure. The planet gear 124 is an example of a clutch gear in the present disclosure.

The sun gear 122 is a gear that rotates by the driving power received from the motor 178. For example, the sun gear 122 is coupled with a motor output shaft 1780 included in the motor 178. For example, when the motor output shaft 1780 is rotated by the motor 178, the sun gear 122 rotates on the motor output shaft 1780 centering on the motor output shaft 1780.

The planet gear 124 is a gear that transfers the driving power generated by the motor 178 to the first gear 100. The planet gear 124 is arranged between the sun gear 122 and the first gear 100. For example, the planet gear 124 is installed to mesh with the sun gear 122.

The planet gear 124 performs switching between closing and opening of the transfer path of the driving power between the sun gear 122 and the first gear 100. According to this configuration, when the transfer path of the driving power between the sun gear 122 and the first gear 100 is opened, it is possible to transfer the driving power from the motor 178 to the first gear 100. Further, when the transfer path of the driving power between the sun gear 122 and the first gear 100 is closed, the load of the motor 178 is not applied to the knob 102.

For example, the planet gear 124 moves between a neutral position at which the transfer path is closed and a meshing position at which the transfer path is opened based on the rotation of the motor 178. Here, the neutral position is an example of a first position in the present disclosure, and the meshing position is an example of a second position in the present disclosure. The neutral position is a position at which the planet gear 124 does not come in contact with the central gear 110, for example, as illustrated in FIG. 5. The meshing position is a position at which the planet gear 124 meshes with the central gear 110, for example, as illustrated in FIG. 12 which will be described later.

In further detail, first, as the planet gear 124 revolves around, for example, the motor output shaft 1780 based on the rotation of the motor 178, the carrier 1200 moves until it comes into contact with the stopper 140. As a result, the planet gear 124 moves from the neutral position to the meshing position.

Then, the planet gear 124 rotates at the position of the planet gear 124 at which the carrier 1200 comes into contact with the stopper 140 based on the rotation in the same direction of the motor 178. As a result, the driving power from the motor 178 is transferred to the central gear 110 and the first gear 100.

In thumb-turns that are currently used, the rotation direction for unlocking or locking differs according to a type. For this reason, in order to enable as many types of thumb-turns as possible to perform unlocking and locking, it is desirable that the first gear 100 be able to rotate in two directions, that is, clockwise and counterclockwise, according to driving of the motor 178. In this regard, the two planet gears 124 may be installed as illustrated in FIG. 5. According to this configuration, for example, when the motor 178 rotates in a first direction in a state in which the two planet gears 124 are positioned at the neutral position, it is possible to cause the first gear 100 to rotate clockwise by moving one of the two planet gears 124 to the meshing position. Further, when the motor 178 rotates in an opposite direction to the first direction, it is possible to cause the first gear 100 to rotate counterclockwise by moving the other of the two planet gears 124 to the meshing position.

The carrier 1200 is, for example, a cover that entirely covers the clutch 120.

(2-1-1-5. Manual Detection Switch 172)

The manual detection switch 172 is an example of an operation detecting unit in the present disclosure. The manual detection switch 172 is a switch for detecting a start of an operation of the user turning the knob 102. For example, the manual detection switch 172 includes a detecting unit 1720, and detects a start of rotation of the first gear 100 according to whether or not the detecting unit 1720 comes into contact with the first gear 100.

Here, the above content will be described in detail with reference to FIGS. 7 and 8. FIG. 7 is an explanatory view illustrating a positional relation between the detecting unit 1720 and a protrusion 1000 included in the first gear 100 when the detection result obtained by the manual detection switch 172 is OFF. As illustrated in FIG. 7, the first gear 100 includes a plurality of protrusions 1000 in which intervals of the neighboring protrusions 1000 are decided according to a predetermined angle ('α' in FIG. 7), for example. Here, the predetermined angle may be, for example, 45°. This is because, in many thumb-turns that are currently used, as an angle of unlocking and locking is decided to be a predetermined interval of 45° or more such as 45°, 90°, or 180°.

For example, when the detection result obtained by the manual detection switch 172 is OFF, the detecting unit 1720 comes into contact with none of the protrusions 1000 as illustrated in FIG. 7.

FIG. 8 is an explanatory view illustrating a positional relation between the detecting unit 1720 and the protrusion 1000 when the user rotates the knob 102 about "α/2" counterclockwise in FIG. 7 in the state illustrated in FIG. 7. When the detection result obtained by the manual detection switch 172 is OFF, and the detecting unit 1720 comes into contact with the protrusion 1000*b* as illustrated in FIG. 8, the manual detection switch 172 detects the start of the rotation of the first gear 100. For example, in the above case, the manual detection switch 172 switches the detection result from OFF to ON.

(2-1-1-6. Clutch Position Detection Switch 176)

The clutch position detection switch 176 is an example of a detecting unit in the present disclosure. The clutch position detection switch 176 detects whether or not the position of the planet gear 124 is the meshing position. For example, as illustrated in FIG. 5, the clutch position detection switch 176 includes a detecting unit 1760, and detects whether or not the position of the planet gear 124 is the meshing position according to whether or not the detecting unit 1760 comes into contact with the carrier 1200. For example, when the detecting unit 1760 comes into contact with a side surface 1202*a* of a concave portion included in the carrier 1200 illustrated in FIG. 5 or a side surface 1202*b* of the concave portion, the clutch position detection switch 176 detects that the position of the planet gear 124 is the meshing position. Further, when the detecting unit 1760 does not come into contact with the side surface 1202 of the concave portion, the clutch position detection switch 176 detects that the position of the planet gear 124 is the neutral position.

(2-1-1-7, Motor 178)

The motor 178 is a motor including the motor output shaft 1780. The motor 178 rotates, for example, the motor output shaft 1780 according to control of the motor control unit 152 which will be described later.

(2-1-1-8. Torque Limiter 130)

The torque limiter 130 is installed between the sun gear 122 and the motor output shaft 1780. For example, when torque applied to the torque limiter 130 exceeds a predetermined threshold value, the torque limiter 130 slides around the motor output shaft 1780.

Here, the above content will be described in detail with reference to FIG. 9. FIG. 9 is an enlarged view of a cross-sectional region 30 illustrated in FIG. 6. As illustrated in FIG. 9, for example, the torque limiter 130 is installed on a friction plate 1210. The friction plate 1210 is installed on a plate spring 1212.

Further, the torque limiter 130 is designed to slide on the friction plate 1210 when the torque applied to the torque limiter 130 exceeds a predetermined threshold value. Further, when the torque applied to the torque limiter 130 is a predetermined threshold value or less, the torque limiter 130 does not slide on the friction plate 1210.

Effect 1

According to this configuration, for example, when the motor 178 stops, and any one of the two planet gears 124 is positioned at the meshing position, if the user rotates the knob 102 by strong force, the force of the hand of the user is transferred to the torque limiter 130 via the central gear 110 and the planet gear 124, and thus the user can cause the torque limiter 130 to slide on the friction plate 1210. As a result, even when the planet gear 124 is positioned at the meshing position, the user can manually rotate the thumb-turn.

Further, the motor 178 stops, and the planet gear 124 is positioned at the meshing position, for example, when the electric energy of the battery cell (not illustrated) installed in the lock control device 10-1 is insufficient or when the motor 178 is broken.

Effect 2

In normal circumstances, a predetermined magnitude of friction force works between the torque limiter 130 and the friction plate 1210, and thus the torque limiter 130 does not slide on the friction plate 1210.

The friction plate 1210 may be installed on the plate spring 1212. Thus, when the torque applied to the torque limiter 130 exceeds a predetermined threshold value, the torque limiter 130 can slide around the motor output shaft 1780 more smoothly (than when the plate spring 1212 is not installed).

{2-1-2, Internal Configuration}

The exterior of the lock control device 10-1 has been described above. Next, an internal configuration of the lock control device 10-1 will be described in detail. FIG. 10 is a functional block diagram illustrating an example of the internal configuration of the lock control device 10-1. As illustrated in FIG. 10, the lock control device 10-1 includes a control unit 150, a communication unit 170, the manual detection switch 172, the rotation measuring unit 174, the clutch position detection switch 176, the motor 178, and a storage unit 180, A description of duplicated content with the above description will be omitted.

(2-1-2-1. Control Unit 150)

The control unit 150 controls the operation of the lock control device 10-1 in general using hardware installed in the lock control device 10-1 such as a central processing unit (CPU), a random access memory (RAM), and a read only memory (ROM). As illustrated in FIG. 10, the control unit 150 includes the motor control unit 152, a measurement control unit 154, a locked state determining unit 156, and a log recording unit 158.

(2-1-2-2. Motor Control Unit 152)

The motor control unit 152 controls the rotation of the motor 178. For example, when a key driving request is acquired, the motor control unit 152 controls the rotation of the motor 178 based on the acquired key driving request. After the key driving based on the key driving request ends, the motor control unit 152 controls the rotation of the motor 178 based on the detection result obtained by the clutch position detection switch 176. Here, the key driving request may be received from, for example, the user terminal 20. Alternatively, the key driving request may be a request that is generated at a predetermined timing by the control unit 150, for example, generated at a predetermined timing by an automatic lock system mounted in the lock control device 10-1.

Control Example 1

For example, when the key driving request is acquired, the motor control unit 152 controls the rotation of the motor 178 so that, of the two planet gears 124, the position of the planet gear 124 corresponding to the key driving request moves from the neutral position to the meshing position.

Here, the above function will be described in detail with reference to FIGS. 11 to 13. FIG. 11 is an explanatory view illustrating a positional relation between the clutch 120 and the central gear 110 before the key driving request is acquired. In the state illustrated in FIG. 11, when the key driving request for unlocking is acquired, the motor control unit 152 controls the rotation of the motor 178 such that the motor output shaft 1780 rotates clockwise by a predetermined rotation amount in FIG. 11, for example. As a result, as illustrated in FIG. 12, the position of the planet gear **124*b* reaches the meshing position, and then the driving power generated by the motor 178 is transferred to the sun gear 122, the planet gear 124*b*, the central gear 110, and the first gear 100** in order.

In the state illustrated in FIG. 11, when the key driving request for locking is acquired, the motor control unit 152 controls the rotation of the motor 178 such that the motor output shaft 1780 rotates counterclockwise by a predetermined rotation amount in FIG. 11, for example. As a result, as illustrated in FIG. 13, the position of the planet gear **124*a* reaches the meshing position, and then the driving power generated by the motor 178 is transferred to the sun gear 122, the planet gear 124*a*, the central gear 110, and the first gear 100** in order.

The above description has been made in connection with the example in which the sun gear 122 is rotated clockwise in FIG. 11 at the time of the unlocking request, and the sun gear 122 is rotated counterclockwise in FIG. 11 at the time of the locking request, but the present disclosure is not limited to this example, and the rotation directions may both be reversed.

Control Example 2

Further, when the key driving according to the acquired key driving request ends, the motor control unit 152 controls the rotation of the motor 178 such that of the two planet gears 124, the position of the planet gear 124 corresponding to the key driving request moves from the meshing position to the neutral position. More specifically, in the above case, first, the motor control unit 152 causes the motor 178 to start the rotation so that the motor output shaft 1780 rotates in the opposite direction to the rotation direction when the key driving request is acquired. Then, when the clutch position detection switch 176 detects that the position of the planet gear 124 corresponding to the key driving request moves from the meshing position to the neutral position, the motor control unit 152 causes the motor 178 to end the rotation.

(2-1-2-3. Measurement Control Unit 154)

The measurement control unit 154 controls the measurement of the rotation amount of the first gear 100 by the rotation measuring unit 174 based on the detection result obtained by the manual detection switch 172. For example, when the start of the rotation of the first gear 100 is detected by the manual detection switch 172, the measurement control unit 154 causes the rotation measuring unit 174 to start the measurement of the rotation amount of the first gear 100. Further, when the rotation measuring unit 174 is performing the measurement, and the manual detection switch 172 detects that the first gear 100 has not rotated for a predetermined period of time or more, the measurement control unit 154 causes the rotation measuring unit 174 to end the measurement of the rotation amount of the first gear 100.

(2-1-2-4. Locked State Determining Unit 156)

The locked state determining unit 156 determines whether or not the thumb-turn is in a locked state based on the measurement result obtained by the rotation measuring unit 174. For example, the locked state determining unit 156 determines whether or not the thumb-turn is in the locked state based on the measurement result obtained by the rotation measuring unit 174 when the measurement performed by the rotation measuring unit 174 ends.

(2-1-2-5. Log Recording Unit 158)

The log recording unit 158 records the measurement result obtained by the rotation measuring unit 174 and the determination result obtained by the locked state determining unit 156 in an operation log DB 182 which will be described later.

Operation Log DB 182

The operation log DB 182 is a database in which a log of operations on the lock control device 10-1 is stored. For example, operation dates and times, measured rotation amounts of the first gear 100, and the locked state of the thumb-turn determined after each operation are stored in the operation log DB 182 in association with one another. The measured rotation directions of the first gear 100 may further be stored in the operation log DB 182 in association with them. Further, identification information of the user terminal 20 and content of the key driving request received from the user terminal 20 may also be stored in the operation log DB 182 in association with each other.

(2-1-2-6. Communication Unit 170)

The communication unit 170 performs transmission and reception of information with another device through wireless communication, for example, according to BLE or the like. For example, the communication unit 170 receives the key driving request from the user terminal 20.

(2-1-2-7. Storage Unit 180)

The storage unit 180 may store various kinds of data such as the operation log DB 182 or various kinds of software.

The functions of the other components are substantially the same as in the above description.

<2-2. Working>

The configuration according to the first embodiment has been described above. Next, working by the configuration according to the first embodiment will be described.

As described above, when the key driving request is acquired, the motor control unit 152 controls the rotation of the motor 178 such that the motor output shaft 1780 rotates in one direction. As a result, the sun gear 122 connected with the motor output shaft 1780 rotates in one direction, and the position of the planet gear 124 connected with the sun gear 122 moves from the neutral position to the meshing position. Then, the planet gear 124 meshes with the central gear 110, and thus the transfer path of the driving power of the motor 178 is formed between the sun gear 122 and the first gear 100. As a result, the driving power of the motor 178 is transferred to the thumb-turn, and thus the thumb-turn rotates and is unlocked or locked.

Further, when the key driving based on the key driving request ends, the motor control unit 152 controls the rotation of the motor 178 such that the motor output shaft 1780 rotates in the opposite direction to the rotation direction when the key driving request is acquired. As a result, the sun gear 122 rotates in the opposite direction to that when the key driving request is acquired, and thus the position of the planet gear 124 meshing with the central gear 110 moves from the meshing position to the neutral position. Thus, the planet gear 124 is separated from the central gear 110, and the transfer path between the sun gear 122 and the first gear 100 is closed. As a result, the load of the motor 178 is not applied to the knob 102.

<2-3. Operation>

The working according to the first embodiment has been described. Next, an operation according to the first embodiment will be described in "2-3-1. Operation at Time of Unlocking and Locking by Manual Operation" and "2-3-2. Operation at Time of Unlocking and Locking by Motor Driving."

{2-3-1. Operation at Time of Unlocking and Locking by Manual Operation}

First, an operation at the time of unlocking and locking by the manual operation according to the first embodiment will be described with reference to FIG. 14. As illustrated in FIG. 14, first, the user manually turns the knob 102 for unlocking or locking (S101).

At this time, the control unit 150 of the lock control device 10-1 is on standby until the detection result obtained by the manual detection switch 172 changes from OFF to ON (S103). Then, when the manual detection switch 172 is changed to ON (Yes in S103), the control unit 150 sets an external input interrupt to ON (S105).

Then, the rotation measuring unit 174 starts the measurement of the rotation amount of the first gear 100 by starting the measurement of the rotation amount of the central gear 110 according to the control of the measurement control unit 154 (S107).

Thereafter, the control unit 150 is on standby until a predetermined period of time elapses (S109). At this time, when the user rotates the knob 102 a predetermined angle or more, unlocking or locking is performed.

Then, when a predetermined period of time elapses (Yes in S109), the control unit 150 determines whether or not a current detection value obtained by the manual detection switch 172 is OFF (S111). When the current detection value obtained by the manual detection switch 172 is ON (No in S111), the control unit 150 performs the operation of S109 again.

On the other hand, when the current detection value obtained by the manual detection switch 172 is OFF (Yes in S111), the control unit 150 sets the external input interrupt to OFF (S113).

Then, the rotation measuring unit 174 ends the measurement of the rotation amount of the first gear 100 according to the control of the measurement control unit 154 (S115).

Then, the locked state determining unit 156 determines whether or not the thumb-turn is in the locked state based on the measurement result of the rotation amount of the first gear 100 in S107 to S115 (S117).

Thereafter, the log recording unit 158 records the measurement result of the rotation amount of the first gear 100 in S107 to S115 and the determination result of the locked state in S117 in the operation log DB 182 (S119).

{2-3-2. Operation at Time of Unlocking and Locking by Motor Driving}

The operation at the time of unlocking and locking by the manual operation has been described above. Next, an operation at the time of unlocking and locking by the motor driving according to the first embodiment will be described with reference to FIG. 15. As illustrated in FIG. 15, first, the control unit 150 of the lock control device 10-1 determines whether or not the key driving request such as the unlocking request or the locking request is acquired from the user terminal 20 (S201). When the key driving request is not acquired (No in S201), the control unit 150 is on standby, for example, for a predetermined period of time, and then performs the operation of S201 again.

On the other hand, when the key driving request is acquired (Yes in S201), the motor control unit 152 causes the motor 178 to start the rotation such that the motor output shaft 1780 rotates in the rotation direction corresponding to the acquired request (S203).

Thereafter, based on the rotation of the motor 178, of the two planet gears 124, the position of the planet gear **124*a* corresponding to the key driving request moves from the neutral position to the meshing position (S205). As a result, the transfer path of the driving power by the motor 178 is opened between the sun gear 122 and the first gear 100. As a result, the driving power by the motor 178 is transferred to the first gear 100 (S207**).

Thereafter, the motor control unit 152 causes the motor 178 to continuously perform the rotation until the motor output shaft 1780 rotates by a predetermined rotation amount (S209). As a result, unlocking or locking is performed.

Then, when the motor output shaft 1780 rotates by a predetermined rotation amount (Yes in S209), the motor control unit 152 performs switching to the opposite direction to the rotation direction of the motor output shaft 1780, and then causes the motor 178 to resume the rotation (S211).

Then, when the clutch position detection switch 176 detects that the position of the planet gear 124*a* moves from the meshing position to the neutral position (Yes in S213), the motor control unit 152 causes the motor 178 to end the rotation (S215).

<2-4. Effects>

{2-4-1. Effect 1}

As described above, when the key driving request is acquired, the lock control device 10-1 according to the first embodiment rotates the motor 178 in one direction and moves the position of the planet gear 124 from the neutral position to the meshing position. As a result, the transfer path of the driving power of the motor 178 is opened between the sun gear 122 and the first gear 100. Thus, since the driving power of the motor 178 is transferred to the thumb-turn, it is possible to automatically rotate the thumb-turn and perform unlocking or locking.

{2-4-2. Effect 2}

After the key driving based on the key driving request ends, the lock control device 10-1 rotates the motor 178 in the opposite direction to that when the key driving request is acquired, and moves the position of the planet gear 124 from the meshing position to the neutral position. As a result, the transfer path between the sun gear 122 and the first gear 100 is closed. Thus, since the load of the motor 178 is not applied to the knob 102, the user can manually turn the knob 102 easily and turn the thumb-turn.

Further, since the user can manually turn the knob 102 360° or more, it is possible to manually turn the thumb-turn 360° or more. For example, even in the thumb-turn of the type in which the rotation angle for unlocking or locking is larger than 90°, the user can manually perform unlocking or locking.

{2-4-3. Effect 3}

Further, since the load of the motor 178 is not applied to the knob 102 (after the key driving based on the key driving request ends), it is possible to use a gear having large static friction and a low reduction ratio, for example, as the sun gear 122 or the first gear 100. Thus, even when the lock control device 10-1 has a small size, it is possible to unlock or lock the thumb-turn having large torque.

{2-4-4. Effect 4}

The lock control device 10-1 causes the rotation measuring unit 174 to measure the rotation amount of the first gear 100 only when the manual operation by the user is detected. Thus, it is possible to record the log of the manual operation on the lock control device 10-1 while suppressing the power consumption by the rotation measuring unit 174.

3. Second Embodiment

<3-1. Background>

The first embodiment has been described above. Next, a second embodiment will be described. First, the background that led to the creation of the second embodiment will be described with reference to FIG. 16. The lock control devices 10 according to embodiments are attached to the door to cover the thumb-turn by the user as indicated by an arrow A illustrated in FIG. 16, for example.

Meanwhile, depending on an attachment method used by the user, misalignment is assumed to occur between the thumb-turn of the attachment target and the output shaft of the lock control device 10 as indicated by two alternate long and short dash lines illustrated in FIG. 16. Further, when the misalignment occurs, it is difficult for the lock control device 10 to rotate the thumb-turn or large load torque is generated, and thus the power consumption is likely to increase.

In order to prevent the occurrence of the misalignment, for example, a method of attaching the lock control device 10 using a positioning guide such as a position indication card or a predetermined tool is considered. According to this method, it is possible to attach the lock control device 10 to a more appropriate position.

However, even in this method, it is necessary for the user to attach it using visual estimation, and thus the misalignment may occur. For example, in a thumb-turn having a complicated external shape, it is difficult to accurately find the rotation center of the thumb-turn using visual estimation, and a large difference may occur between an estimated rotation center and an actual rotation center. Even in this method, there is a problem in that types of thumb-turns to which it is applicable are limited.

As will be described later, the lock control device 10-2 according to the second embodiment includes an Oldham coupling 192 coupled to the output shaft 1020 and can absorb a deviation on a door plane between the rotation center of the thumb-turn and the rotation center of the output shaft 1020.

<3-2. Configuration>

Next, a configuration according to the second embodiment will be described in detail. In the following, a description of the same content as in the first embodiment will be omitted.

The lock control device 10-2 includes an attachment 190-2 instead of the attachment 190-1. FIG. 17 is a left side view illustrating an exterior of portions inside the attachment 190-2 according to the second embodiment. As illustrated in FIG. 17, the attachment 190-2 includes the Oldham coupling 192.

{3-2-1. Oldham Coupling 192}

The Oldham coupling 192 is a mechanism configured with, for example, an orthogonal biaxial slide mechanism and coupled to the output shaft 1020. FIG. 18 is a perspective view illustrating a configuration of the Oldham coupling 192. As illustrated in FIG. 18, the Oldham coupling 192 includes a first joint member 1920, an intermediate member 1922, a second joint member 1924, and an attachment member 1926.

(3-2-1-1. First Joint Member 1920)

FIG. 19 is an exploded perspective view illustrating a configuration of the Oldham coupling 192. As illustrated in FIG. 19, the first joint member 1920 includes two its convex portions 1930, a first opening 1932, and a second opening 1934 which are formed on a first end surface of the first joint member 1920. Here, the first end surface is a surface facing the intermediate member 1922. The convex portion 1930 is formed to protrude from the first end surface toward the intermediate member 1922. A thread groove (not illustrated) to which a screw 300 which will be described later is formed in the convex portion 1930. The first opening 1932 is an opening that is formed, for example, at a central position of the first joint member 1920, and has a size through which a front edge of the output shaft 1020 can pass. For example, the first opening 1932 may have substantially the same size as a cross section (vertical to an axial direction of the output shaft 1020) in the front edge of the output shaft 1020. The second opening 1934 is an opening having a size through which a shaft of a screw 304 passes. For example, the second opening 1934 may have substantially the same size as a cross section of the shaft vertical to the axial direction of the screw 304. The second opening 1934 passes through the first opening 1932.

The front edge of the output shaft 1020 is inserted into the first opening 1932. Then, the shaft of the screw 304 is inserted into the first opening 1932 and an opening 1022 of the output shaft 1020, and the front edge of the shaft of the screw 304 is coupled to a thread groove of the coupling part 306. Accordingly, the output shaft 1020 is fixed to the first joint member 1920.

(3-2-1-2. Intermediate Member 1922)

The intermediate member 1922 is arranged between the first joint member 1920 and the second joint member 1924. The intermediate member 1922 includes, for example, two first slide openings 1940, two second slide openings 1942, and an opening 1944. Here, in the first slide opening 1940, a length in a first direction in the end surface of the intermediate member 1922 is larger than a length in a second direction serving as a direction orthogonal to the first direction in the end surface by a predetermined length or more. In the second slide opening 1942, a length in the second direction in the end surface is larger than a length in the first direction in the end surface by a predetermined length. For example, the first slide opening 1940 and the second slide opening 1942 are elongate holes.

The first slide opening 1940 and the second slide opening 1942 are formed in the intermediate member 1922 in a positional relation in which a straight line passing through the center of the first slide opening 1940 and the center of the intermediate member 1922 is orthogonal to a straight line passing through the center of the second slide opening 1942 and the center of the intermediate member 1922. Further, the first slide opening 1940*a* and the first slide opening 1940*b* are positioned at a position symmetric to the straight line passing through the center of the second slide opening 1942 and the center of the intermediate member 1922. Similarly, the second slide opening 1942*a* and the second slide opening 1942*b* are positioned at symmetric positions with respect to the straight line passing through the center of the first slide opening 1940 and the center of the intermediate member 1922.

The shaft of the screw 300 is inserted into the first slide opening 1940, and the front edge of the shaft of the screw 300 is coupled to the thread groove of the convex portion 1930 (of the first joint member 1920). Accordingly, the intermediate member 1922 is fixed to the first joint member 1920 in the second direction and slidably fixed in the first direction.

The opening 1944 is an opening that is formed at the central position of the intermediate member 1922 and has a size through which the front edge of the output shaft 1020 can pass. For example, in the opening 1944, a length in the first direction is larger than in the first opening 1932 (of the first joint member 1920) by a predetermined length. Here, the predetermined length may be substantially the same as the length of the first slide opening 1940 in the first direction.

(3-2-1-3. Second Joint Member 1924)

The second joint member 1924 includes, for example, two convex portions 1950 and an opening 1952 which are formed on a first end surface of the second joint member 1924. Here, the first end surface is a surface facing the intermediate member 1922. The convex portion 1950 is formed to protrude from the first end surface toward the intermediate member 1922. A thread groove (not illustrated) to which a screw 302 can be coupled is formed in the convex portion 1950.

The shaft of the screw 302 is inserted into the second slide opening 1942 (of the intermediate member 1922), and the front edge of the shaft of the screw 302 is coupled to the thread groove of the convex portion 1950. Accordingly, the intermediate member 1922 is fixed to the second joint member 1924 in the first direction and slidably fixed in the second direction.

The opening 1952 is an opening that is formed at the central position of the second joint member 1924 and has a size through which the front edge of the output shaft 1020 can pass. For example, in the opening 1952, a length in the second direction in the first end surface is larger than in the opening 1944 (of the intermediate member 1922) by a predetermined length. Here, the predetermined length may be substantially the same as the length of the second slide opening 1942 in the second direction.

(3-2-1-4. Attachment Member 1926)

The attachment member 1926 includes a groove 1960 in which the thumb-turn is interposed on a first end surface of the attachment member 1926. Here, the first end surface is an end surface at an opposite side of a second end surface facing the second joint member 1924. The groove 1960 has a predetermined length. For example, the length of the groove 1960 may be substantially the same as the diameter of the attachment member 1926. The groove 1960 may be formed to include the central position in the first end surface.

The attachment member 1926 can be coupled to the second joint member 1924. For example, the attachment member 1926 can be attached to or detached from the second joint member 1924 by the user. According to this configuration, the user can combine the attachment member 1926 in which the length of the width of the groove 1960 is appropriate for the second joint member 1924 according to the size of the thumb-turn of the attachment target. For example, three types of attachment members 1926 in which the width of the groove 1960 is, for example, S, M, and L may be prepared. The user may select the attachment member 1926 of the type in which the length of the width of the groove 1960 is appropriate from among the three types of attachment members 1926 according to the size of the thumb-turn of the attachment target and combine the selected attachment member 1926 with the second joint member 1924. Accordingly, it is possible to absorb a large error (on a door plane) that is hardly absorbed through the Oldham coupling 192 in advance.

Configurations and functions of the other components are the same as in the first embodiment.

<3-3. Working>

The configuration according to the second embodiment has been described above. Next, working by the configuration according to the second embodiment will be described with reference to FIG. 20. FIG. 20 is a perspective view illustrating an example of a motion of the Oldham coupling 192 at the time of the rotation of the output shaft 1020 when the rotation center of the output shaft 1020 deviates from the rotation center of the thumb-turn on a door plane (an XY plane). For example, as illustrated in FIG. 16, the rotation axis of the thumb-turn faces in a direction (a Z axis direction) vertical to the door plane (the XY plane).

As described above, the intermediate member 1922 is fixed to the first joint member 1920 to be slidable in the X axis direction (the direction corresponding to the first direction) on the door plane. The intermediate member 1922 is fixed to the second joint member 1924 to be slidable in the Y axis direction (the direction corresponding to the second direction) on the door plane.

Thus, when the output shaft 1020 rotates in the state in which the rotation center of the output shaft 1020 deviates from the rotation center of the thumb-turn on the door plane, the first joint member 1920 fixed to the output shaft 1020 rotates, and thus the intermediate member 1922 rotates such that the rotation center of the intermediate member 1922 moves toward the first joint member 1920 in the X axis direction and moves toward the second joint member 1924 in the Y axis direction. For example, the intermediate member 1922 rotates such that the rotation center of the intermediate member 1922 moves toward the first joint member 1920 in the X axis direction as indicated by an arrow p illustrated in FIG. 20 and moves toward the second joint member 1924 in the Y axis direction as indicated by an arrow Q illustrated in FIG. 20.

As described above, the intermediate member 1922 rotates such that the rotation center of the intermediate member 1922 appropriately moves on the door plane according to the positional relation (deviation) on the door plane between the rotation center of the output shaft 1020 and the rotation center of the thumb-turn. As a result, the rotation of the output shaft 1020 is transferred to the attachment member 1926 without change through the rotation of the intermediate member 1922. Thus, the rotation of the output shaft 1020 is transferred to the thumb-turn without change, and thus the thumb-turn rotates.

Further, when there is an error in the Z direction between (the attachment member 1926 of) the lock control device 10-2 and the thumb-turn, the user loosens the screw 304 and adjusts the fixing position of the screw 304 with respect to the opening 1022 (of the output shaft 1020), and thus the error in the Z direction can be absorbed in advance.

<3-4. Operation>

The operation according to the second embodiment is the same as the operation according to the first embodiment.

<3-5. Effects>

{3-5-1. Effect 1}

As described above, the lock control device 10-2 according to the second embodiment includes the Oldham coupling 192 coupled to the output shaft 1020, and thus even if the thumb-turn is attached to the door in the state in which the rotation center of the output shaft 1020 deviates from the rotation center of the thumb-turn in the door plane, it is possible to absorb the deviation of the rotation center in the door plane, and it is possible to transfer the rotation of the output shaft 1020 to the thumb-turn without change.

Thus, it is possible to rotate the thumb-turn smoothly without increasing the torque load. As a result, it is possible to suppress the power consumption, increase the lifespan of the battery cell, and reduce the number of battery cell exchanges. Further, it is possible to prevent the occurrence of trouble in which the lock control device 10-2 does not operate normally.

Particularly, the mechanism that is thin, small in the number of parts, and large in the absorption amount of misalignment in the door plane is employed as the Oldham coupling 192, and thus it is possible to reduce the size of the lock control device 10-2 and the cost and improve the durability thereof.

{3-5-2. Effect 2}

According to the second embodiment, when the user attaches the lock control device 10-2 to the door, a task of attaching the lock control device 10-2 to as accurate a position as possible, for example, using a special tool or the like is not necessary. Thus, the attachment of the lock control device 10-2 is easy, and thus user convenience is improved.

4. Modifications

Embodiments of the present disclosure have been described above with reference to the accompanying drawings, whilst the present disclosure is not limited to the above examples, of course. A person skilled in the art may find various alterations and modifications within the scope of the appended claims, and it should be understood that they will naturally come under the technical scope of the present disclosure.

<4-1. Modification 1>

For example, the above embodiments have been described in connection with the example in which the motor gear according to an embodiment of the present disclosure is the sun gear 122, but the present disclosure is not limited to this example. When one or more gears are arranged between the sun gear 122 and the planet gear 124, the motor gear may be any one of the one or more gears.

<4-2. Modification 2>

Further, the above embodiments have been described in connection with the example in which the clutch 120 includes the two planet gears 124, but the present disclosure is not limited to this example. For example, the clutch 120 may include one planet gear 124. In the lock control device 10 according to the modification, the planet gear 124 is able not only to revolve around, for example, the motor output shaft 1780 but also to revolve away from the central gear 110 more than 180°. Thus, similarly to when the two planet gears 124 are installed, it is possible to rotate the first gear 100 in the two rotation directions, that is, clockwise and counter-clockwise.

<4-3. Modification 3>

Further, the above embodiments have been described in connection with the example in which the manual detection switch 172 detects the start of the manual operation of the user on the knob 102 by detecting the rotation of the first gear 100, but the present disclosure is not limited to this example. For example, the manual detection switch 172 may be installed around the central gear 110 and detect the start of the manual operation of the user on the knob 102 by detecting the rotation of the central gear 110.

<4-4. Modification 4>

Further, the above embodiments have been described in connection with the example in which the lock control device 10 is installed in the front door or the room door of the house, but the present disclosure is not limited to this example. The lock control device 10 may be installed in various kinds of doors such as locker doors installed in an airport, a station, or the like or vehicle doors, for example. Further, the lock control device 10 may be applied to locking mechanisms of bicycles or the like.

<4-5. Modification 5>

In addition, the effects described in the present specification are merely illustrative and demonstrative, and not limitative. In other words, the technology according to an embodiment of the present disclosure can exhibit other effects that are evident to those skilled in the art along with or instead of the effects based on the present specification.

Additionally, the present technology also be configured as below.

(1)

An electrical key lock device, including:

a second gear configured to rotate by driving power received from a motor;

a first gear configured to transfer the driving power, received through the rotation of the second gear, to an external rotational element; and a third gear arranged between the second gear and the first gear and configured to transfer the driving power generated by the motor to the first gear, wherein the third gear enables switching between closing and opening of a transfer path of the driving power between the second gear and the first gear.

(2)

The electrical key lock device according to (1), wherein the third gear is a planet gear of the second gear and moves between a first position at which the transfer path is closed and a second position at which the transfer path is opened.

(3)

The electrical key lock device according to (1) or (2), further including a motor controller configured to control rotation of the motor such that the motor rotates, according to an input instruction, to drive the first gear while the transfer path is opened, wherein the third gear moves from the second position to the first position after the driving of the first gear is completed, and wherein the motor controller is implemented via at least one processor.

(4)

The electrical key lock device according to any of (1) to (3), further including a detector configured to detect a position of the third gear, wherein the motor controller controls the rotation of the motor such that, after the driving of the first gear is completed, the detector detects that the third gear is positioned at the first position and the rotation of the motor is stopped.

(5)

The electrical key lock device according to any of (1) to (4), further including a fourth gear arranged between the second gear and the first gear and also configured to transfer the driving power generated by the motor to the first gear, wherein the fourth gear enables switching between closing and opening of an additional transfer path of the driving power between the second gear and the first gear, the fourth gear moves between a third position at which the additional transfer path is closed and a fourth position at which the additional transfer path is opened, the input instruction includes one of an unlocking request or a locking request, the motor controller decides a rotation direction of the motor according to whether the input instruction includes the unlocking request or the locking request, and the motor controller controls the rotation of the motor such that either the third gear moves from the first position to the second position or the or the fourth gear moves from the third position to the fourth position, based on whether the input instruction is the unlocking request or the locking request.

(6)

The electrical key lock device according to any of (1) to (5), wherein the motor includes a motor output shaft, the electrical key lock device further includes a torque limiter installed between the second gear and the motor output shaft, and when torque applied to the torque limiter exceeds a predetermined threshold value, the torque limiter slides around the motor output shaft.

(7)

The electrical key lock device according to any of (1) to (6), wherein a knob for rotating the rotational element manually is installed to be coupled with the first gear.

(8)

The electrical key lock device according to any of (1) to (7), further including an attachment removable from the rotational element and coupled to the first gear.

(9)

The electrical key lock device according to any of (1) to (8), wherein the knob and the attachment are coaxially installed.

(10)

The electrical key lock device according to any of (1) to (9), further including an output shaft coupled to the first gear, wherein the attachment includes an Oldham coupling coupled to the output shaft.

(11)

The electrical key lock device according to any of (1) to (10), further including a rotation measuring unit configured to measure a rotation amount of the first gear.

(12)

The electrical key lock device according to any of (1) to (11) including a fifth gear configured to mesh with the first gear, and having the rotation measuring unit installed therein, wherein the fifth gear is installed between the first gear and the third gear, and the rotation measuring unit measures the rotation amount of the first gear based on measurement of rotation of the fifth gear.

(13)

The electrical key lock device according to any of (1) to (12), further including an operation detector configured to detect a start of rotation of the first gear; and a measurement controller configured to cause the rotation measuring unit to start measurement of the rotation amount of the first gear when the operation detector detects the start of the rotation of the first gear.

(14)

The electrical key lock device according to any of (1) to (13), wherein, when the rotation measuring unit is performing the measurement of the rotation amount of the first gear, and the operation detector detects that the first gear is in a stop state for a predetermined period of time or more, the measurement controller causes the rotation measuring unit to end the measurement of the rotation amount of the first gear.

(15)

The electrical key lock device according to any of (1) to (14), further including a storage configured to store an operation log related to an operation of the knob; and a log recorder configured to record a measurement result obtained by the rotation measuring unit in the operation log.

(16)

The electrical key lock device according to any of (1) to (15), further including a locked state determination unit configured to determine whether or not the external rotational element is in a locked state based on the measurement result obtained by the rotation measuring unit, wherein the log recorder further records a determination result obtained by the locked state determination unit in the operation log.

(17)

The electrical key lock device according to any of (1) to (16), wherein, when the transfer path is closed the third gear is disengaged from driving the first gear, and when the transfer path is opened the third gear is engaged to drive the first gear.

(18)

A key drive device, including:

a motor gear configured to rotate by driving power received from a motor;

a first gear configured to transfer the driving power for rotating a thumb-turn to the thumb-turn; and a clutch gear arranged between the motor gear and the first gear and configured to transfer the driving power generated by the motor to the first gear, wherein the clutch gear performs switching between closing and opening of a transfer path of the driving power between the motor gear and the first gear.

(19)

The key drive device according to (18), wherein the clutch gear is a planet gear of the motor gear and moves between a first position at which the transfer path is closed and a second position at which the transfer path is opened.

(20)

The key drive device according to (19), further including:

a motor control unit configured to control rotation of the motor, wherein the motor control unit controls the rotation of the motor such that the motor rotates according to a key driving request, and after key driving ends, the clutch gear moves from the second position to the first position.

(21)

The key drive device according to (20), further including:

a detecting unit configured to detect a position of the clutch gear, wherein the motor control unit controls the rotation of the motor such that, after the key driving ends, the detecting unit detects that the clutch gear is positioned at the first position.

(22)

The key drive device according to (20) or (21), further including: two clutch gears, the key driving request includes an unlocking request and a locking request, the motor control unit decides a rotation direction of the motor according to whether the key driving request is the unlocking request or the locking request, and the motor control unit controls the rotation of the motor such that one of the two clutch gears moves from the first position to the second position according to whether the key driving request is the unlocking request or the locking request.

(23)

The key drive device according to any one of (19) to (22), wherein the motor includes a motor output shaft, the key drive device further includes:

a torque limiter installed between the motor gear and the motor output shaft, and when torque applied to the torque limiter exceeds a predetermined threshold value, the torque limiter slides around the motor output shaft.

(24)

The key drive device according to any one of (19) to (23), wherein a knob for rotating the thumb-turn manually is installed in the first gear.

(25)

The key drive device according to (24), further including:

an attachment removable from the thumb-turn and coupled to the first gear.

(26)

The key drive device according to (25), wherein the knob and the attachment are coaxially installed.

(27)

The key drive device according to (25) or (26), further including:

an output shaft coupled to the first gear, wherein the attachment includes an Oldham coupling coupled to the output shaft.

(28)

The key drive device according to any one of (24) to (27), further including:

a rotation measuring unit configured to measure a rotation amount of the first gear.

(29)

The key drive device according to (28), further including:

a second gear configured to mesh with the first gear, and having the rotation measuring unit installed therein, wherein the second gear is installed between the first gear and the clutch gear, and the rotation measuring unit measures the rotation amount of the first gear based on measurement of rotation of the second gear.

(30)

The key drive device according to (28) or (29), further including:

an operation detecting unit configured to detect a start of rotation of the first gear; and a measurement control unit configured to cause the rotation measuring unit to start measurement of the rotation amount of the first gear when the operation detecting unit detects the start of the rotation of the first gear.

(31)

The key drive device according to (30), wherein, when the rotation measuring unit is performing the measurement, and the operation detecting unit detects that the first gear is in a stop state for a predetermined period of time or more, the measurement control unit causes the rotation measuring unit to end the measurement of the rotation amount of the first gear.

(32)

The key drive device according to any one of (28) to (31), further including:

a storage unit configured to store an operation log related to an operation of the knob; and a log recording unit configured to record a measurement result obtained by the rotation measuring unit in the operation log.

(33)

The key drive device according to (32), further including:

a locked state determination unit configured to determine whether or not the thumb-turn is in a locked state based on the measurement result obtained by the rotation measuring unit, wherein the log recording unit further records a determination result obtained by the locked state determination unit in the operation log.

REFERENCE SIGNS LIST

10-1, 10-2 lock control device
20 user terminal
100 first gear
102 knob
110 central gear
120 clutch
122 sun gear
124 planet gear
130 torque limiter
140 stopper
150 control unit
152 motor control unit
154 measurement control unit
156 locked state determination unit
158 log recording unit
170 communication unit

172 manual detection switch
174 rotation measuring unit
176 clutch position detection switch
178 motor
180 storage unit
182 operation log DB
190-1, 190-2 attachment
192 Oldham coupling
1000 protrusion
1020 output shaft
1200 carrier
1210 friction plate
1212 plate spring
1780 motor output shaft
1920 first joint member
1922 intermediate member
1924 second joint member
1926 attachment member

The invention claimed is:

1. An electrical key lock device, comprising:

a second gear configured to rotate by driving power received from a motor;

a first gear configured to transfer the driving power, received through the rotation of the second gear, to an external rotational element;

a third gear configured to mesh with the second gear and installed between the second gear and the first gear and configured to transfer the driving power generated by the motor to the first gear; and a fourth gear configured to mesh with the first gear and the third gear, and installed between the first gear and the third gear, wherein the third gear enables switching between closing and opening of a transfer path of the driving power between the second gear and the first gear.

2. The electrical key lock device according to claim 1, wherein the third gear is a planet gear of the second gear and moves between a first position at which the transfer path is closed and a second position at which the transfer path is opened.

3. The electrical key lock device according to claim 2, further comprising:

a motor controller configured to control rotation of the motor such that the motor rotates, according to an input instruction, to drive the first gear while the transfer path is opened, wherein the third gear moves from the second position to the first position after the driving of the first gear is completed, and wherein the motor controller is implemented via at least one processor.

4. The electrical key lock device according to claim 3, further comprising:

a detector configured to detect a position of the third gear, wherein the motor controller controls the rotation of the motor such that, after the driving of the first gear is completed, the detector detects that the third gear is positioned at the first position and the rotation of the motor is stopped.

5. The electrical key lock device according to claim 3, further comprising:

a fifth gear installed between the second gear and the first gear and also configured to transfer the driving power generated by the motor to the first gear, wherein the fifth gear enables switching between closing and opening of an additional transfer path of the driving power between the second gear and the first gear, the fifth gear moves between a third position at which the additional transfer path is closed and a fifth position at which the additional transfer path is opened, the input instruction includes one of an unlocking request or a locking request, the motor controller decides a rotation direction of the motor according to whether the input instruction includes the unlocking request or the locking request, and the motor controller controls the rotation of the motor such that either the third gear moves from the first position to the second position or the or the fourth fifth gear moves from the third position to the fifth position, based on whether the input instruction is the unlocking request or the locking request.

6. The electrical key lock device according to claim 2, wherein the motor includes a motor output shaft, the electrical key lock device further comprises:

a torque limiter installed between the second gear and the motor output shaft, and when torque applied to the torque limiter exceeds a predetermined threshold value, the torque limiter slides around the motor output shaft.

7. The electrical key lock device according to claim 2, wherein a knob for rotating the rotational element manually is installed to be coupled with the first gear.

8. The electrical key lock device according to claim 7, further comprising:

an attachment removable from the rotational element and coupled to the first gear.

9. The electrical key lock device according to claim 8, wherein the knob and the attachment are coaxially installed.

10. The electrical key lock device according to claim 8, further comprising:

an output shaft coupled to the first gear, wherein the attachment includes an Oldham coupling coupled to the output shaft.

11. The electrical key lock device according to claim 7, further comprising:

a rotation measuring unit configured to measure a rotation amount of the first gear.

12. The electrical key lock device according to claim 11, wherein the fourth gear includes the rotation measuring unit installed therein, and the rotation measuring unit measures the rotation amount of the first gear based on measurement of rotation of the fourth gear.

13. The electrical key lock device according to claim 11, further comprising:

an operation detector configured to detect a start of rotation of the first gear; and a measurement controller configured to cause the rotation measuring unit to start measurement of the rotation amount of the first gear when the operation detector detects the start of the rotation of the first gear.

14. The electrical key lock device according to claim 13, wherein, when the rotation measuring unit is performing the measurement of the rotation amount of the first gear, and the operation detector detects that the first gear is in a stop state for a predetermined period of time or more, the measurement controller causes the rotation measuring unit to end the measurement of the rotation amount of the first gear.

15. The electrical key lock device according to claim 11, further comprising:

a storage configured to store an operation log related to an operation of the knob; and a log recorder configured to record a measurement result obtained by the rotation measuring unit in the operation log.

16. The electrical key lock device according to claim 15, further comprising:

a locked state determination unit configured to determine whether or not the external rotational element is in a locked state based on the measurement result obtained by the rotation measuring unit, wherein the log recorder further records a determination result obtained by the locked state determination unit in the operation log.

17. The electrical key lock device according to claim 1, wherein, when the transfer path is closed, the third gear is disengaged from driving the first gear, and when the transfer path is opened, the third gear is engaged to drive the first gear.

* * * * *